US006804639B1

(12) United States Patent
Ehara

(10) Patent No.: US 6,804,639 B1
(45) Date of Patent: Oct. 12, 2004

(54) CELP VOICE ENCODER

(75) Inventor: Hiroyuki Ehara, Yokohama (JP)

(73) Assignee: Matsushita Electric Industrial Co., LTD, Osaka (JP)

( * ) Notice: Subject to any disclaimer, the term of this patent is extended or adjusted under 35 U.S.C. 154(b) by 0 days.

(21) Appl. No.: 09/582,039

(22) PCT Filed: Oct. 26, 1999

(86) PCT No.: PCT/JP99/05885

§ 371 (c)(1),
(2), (4) Date: Jun. 21, 2000

(87) PCT Pub. No.: WO00/25302

PCT Pub. Date: May 4, 2000

(30) Foreign Application Priority Data

Oct. 27, 1998 (JP) ..... 10-305740

(51) Int. Cl.[7] ..... G10L 19/12
(52) U.S. Cl. ..... 704/223; 704/220; 704/207
(58) Field of Search ..... 704/219–230

(56) References Cited

U.S. PATENT DOCUMENTS 5,664,055 A * 9/1997 Kroon ..... 704/223
5,778,335 A * 7/1998 Ubale et al. ..... 704/219
5,778,338 A * 7/1998 Jacobs et al. ..... 704/223
6,188,980 B1 * 2/2001 Thyssen ..... 704/230
6,493,665 B1 * 12/2002 Su et al. ..... 704/230

FOREIGN PATENT DOCUMENTS

| | | |
|---|---|---|
| EP | 0694907 | 1/1996 |
| JP | 6131000 | 5/1994 |
| JP | 7064600 | 3/1995 |

OTHER PUBLICATIONS

PCT International Search Report dated Feb. 1, 2000.
J. Yao et al., "Low–Delay Speech Coding with Adaptive Interframe Pitch Tracking", IEEE, 1993, pp. 410–414.

* cited by examiner

*Primary Examiner*—David D. Knepper
(74) *Attorney, Agent, or Firm*—Stevens, Davis, Miller & Mosher, LLP.

(57) ABSTRACT

A CELP type speech coder performs quantization of pitch differential value on pitch information between subframes. The coder limits the number of preliminary selected candidates using threshold processing. The coder includes specialized pitches for a subframe on which quantization of pitch differential value is not applied. When pitch preliminary selection is performed on such a subframe, the coder limits the number of preliminarily selected candidates using threshold processing to avoid outputting, as a preliminarily selected candidate, the above-mentioned specialized pitches. The coder improves the accuracy of the pitch search (adaptive codebook search) while avoiding adverse effects on the quantization of pitch differential value.

19 Claims, 11 Drawing Sheets

CELP VOICE ENCODER

TECHNICAL FIELD

The present invention relates to a CELP (Code Excited Linear Prediction) type speech coding apparatus which encodes a speech signal to transmit in, for example, a mobile communication system.

BACKGROUND ART

Used in the fields of digital mobile communications and speech storage are speech coding apparatuses which compress speech information to encode with high efficiency for utilization of radio signals and recording media. Among them, the system based on a CELP (Code Excited Linear Prediction) system is carried into practice widely for the apparatuses operating at medium to low bit rates. The technology of the CELP is described in "Code-Excited Linear Prediction (CELP):High-quality Speech at Very Low Bit Rates" by M. R. Schroeder and B. S. Atal, Proc. ICASSP-85, 25.1.1., pp.937–940, 1985.

In the CELP type speech coding system, speech signals are divided into predetermined frame lengths (about 5 ms to 50 ms), linear prediction of the speech signals is performed for each frame, the prediction residual (excitation vector signal) obtained by the linear prediction for each frame is coded using an adaptive code vector and random code vector comprised of known waveforms.

The adaptive code vector is selected for use from an adaptive codebook storing previously generated excitation vectors, and the random code vector is selected for use from a random codebook storing a predetermined number of pre-prepared vectors with predetermined shapes.

In particular, used as the random code vectors stored in the random codebook are, for example, random noise sequence vectors and vectors generated by arranging a few pulses at different positions. In particular, one of representative examples of the latter is CS-ACELP (Conjugate Structure and Algebraic CELP) recommended as an international standard by ITU-T in 1996. The technology of the CS-ACELP is described in "Recommendation G.729:Coding of Speech at 8 kbit/s using Conjugate-Structure Algebraic-Code-Excited Linear-Prediction (CS-ACELP)", March 1996.

In addition, the CS-ACELP uses an algebraic codebook as a random codebook. The random code vector generated from the algebraic codebook in the CS-ACELP is such a vector that four impulses each with an amplitude of −1 or +1 are prepared (regions other than positions with the four prepared pulses are basically all 0)in 40 samples (5 ms) per subframe basis. Since an absolute value of the amplitude is fixed to 1, it is enough to represent only a position and polarity (positive or negative) of each pulse to represent an excitation vector. Therefore it is not necessary to store a vector with 40 dimensions (subframe length) in a codebook, and a memory for codebook storage is not required. Further since four pulses with amplitudes of 1 are only present in the vector, this method has futures such that the computation amount for codebook search is largely reduced.

In the CS-ACELP, adaptive code vector information is efficiently coded by representing a pitch of a second subframe by performing quantization on a pitch differential value using a pitch of a first subframe. Further in the pitch search, a constitution is adopted in which one pitch candidate is selected by open loop pitch search for each frame, and closed loop pitch search for each subframe is performed around the pitch candidate, whereby it is designed to also reduce the computation amount required for the search.

Herein a conventional CS-ACELP coding apparatus is specifically explained with reference to FIG. 1. FIG. 1 illustrates a basic configuration of the conventional CS-ACELP speech coding apparatus. In FIG. 1, input buffer 1 performs buffering of data with a required length while updating an input digital speech signal for each frame, and outputs required data to subframe divider 2, LPC analyzer 3, and weighted synthesis filter 4.

Subframe divider 2 divides a frame of the input digital signal, input from input buffer 1, into two subframes, outputs a first subframe signal to first target calculator 5, and further outputs a second subframe signal to second target calculator 6. LPC analyzer 3 receives a digital speech signal required for analysis input from input buffer 1 to perform LPC analysis, and outputs linear predictive coefficients to LPC quantizer 7 and second LPC interpolator 8. Weighted synthesis filter 4 receives as inputs the frame of the digital speech signal input from input buffer 1 and linear predictive coefficients a1 and a2 output from second LPC interpolator 8, and performs perceptual weighting on the input speech signal to output to open loop pitch searcher 9.

LPC quantizer 7 performs quantization on the linear predictive coefficients output from LPC analyzer 3, outputs quantized LPC to first LPC interpolator 10, and at the same time outputs coding data L of the quantized LPC to a decoder. Second LPC interpolator 8 receives as inputs the LPC output from LPC analyzer 3, performs interpolation on LPC of the first subframe, and outputs unquantized LPC of the first and second subframes respectively as a1 and a2. First LPC interpolator 10 receives as inputs the quantized LPC output from LPC quantizer 7, performs interpolation on the quantized LPC of the first subframe, and outputs quantized LPC of the first and second subframes respectively as qa1 and qa2.

First target calculator 5 receives as inputs the first subframe of the digital speech signal divided in subframe divider 2, filter state st1 output from second filter state updator 11 on the last second subframe, and qa1 and a1 that are respectively the quantized LPC and unquantized LPC of the first subframe, and calculates a target vector to output to first closed loop pitch searcher 12, first target updator 13, first gain codebook searcher 14, and first filter state updator 15. Second target calculator 6 receives as inputs the second subframe of the digital speech signal output from subframe divider 2, filter state st2 output from first filter state updator 15 on the first subframe of a current frame, and qa2 and a2 that are respectively the quantized LPC and unquantized LPC of the second subframe, and calculates a target vector to output to second closed loop pitch searcher 16, second target updator 17, second gain codebook searcher 18, and second filter state updator 11.

Open loop pitch searcher 9 receives as an input a weighted input speech signal output from weighted synthesis filter 4 to extract a pitch periodicity, and outputs an open loop pitch period to first closed loop pitch searcher 12. First closed loop pitch searcher 12 receives a first target vector, open loop pitch, adaptive code vector candidates, and an impulse response vector respectively input from first target calculator 5, open loop pitch searcher 9, adaptive codebook 19, and first impulse response calculator 20, performs closed loop pitch search around the open loop pitch, outputs closed loop pitch P1 to second closed loop pitch searcher 16, first pitch period processing filter 21 and the decoder, outputs an adaptive code vector to first excitation generator 22, and further outputs a synthetic vector obtained by performing convolution of the first impulse response and the adaptive code vector to first target updator 13, first gain codebook searcher 14, and first filter state updator 15.

First target updator 13 receives the first target vector and a first adaptive code synthetic vector respectively input from first target calculator 5 and first closed loop pitch searcher 12, and calculates a target vector for the random codebook to output to first random codebook searcher 23. First gain codebook searcher 14 receives the first target vector, the first adaptive code synthetic vector, and a first random code synthetic vector respectively input from first target calculator 5, first closed loop pitch searcher 12 and first random codebook searcher 23, and selects an optimum quantized gain from gain codebook 29 to output to first excitation generator 22 and first filter state updator 15.

First filter state updator 15 receives the first target vector, first adaptive code synthetic vector, first random code synthetic vector, and a first quantized gain respectively input from first target calculator 5, first closed loop pitch searcher 12, first random codebook searcher 23 and first gain codebook searcher 14, updates a state of a synthesis filter, and outputs filter state st2. First impulse response calculator 20 receives as inputs a1 and qa1 that are respectively unquantized LPC and quantized LPC of the first subframe, and calculates an impulse response of a filter constructed by connecting a perceptual weighting filter and the synthesis filter, to output to first closed loop pitch searcher 12 and first pitch period processing filter 21.

First pitch period processing filter 21 receives a first closed loop pitch and first impulse response vector respectively input from first closed loop pitch searcher 12 and first impulse response calculator 20, and performs pitch period processing on the first impulse response vector to output to first random codebook searcher 23. First random codebook searcher 23 receives as inputs an updated first target vector output from first target updator 13, a period processed first impulse response vector output from first pitch period processing filter 21, and random code vector candidates output from random codebook 24, selects an optimum random code vector from random codebook 24, outputs a vector obtained by performing period processing on the selected random code vector to first excitation generator 22, outputs a synthetic vector obtained by performing convolution of the period processed first impulse response vector and the selected random code vector to first gain codebook searcher 14 and first filter state updator 15, and outputs code S1 representative of the selected random code vector to the decoder.

Random codebook 24 stores a predetermined number of random code vectors with the predetermined shapes, and outputs a random code vector to first random codebook searcher 23 and second random codebook searcher 25.

First excitation generator 22 receives the adaptive code vector, random code vector, and quantized gains respectively input from first closed loop pitch searcher 12, first random codebook searcher 23 and first gain codebook searcher 14, generates an excitation vector, and outputs the generated excitation vector to adaptive codebook 19. Adaptive codebook 19 receives as an input the excitation vector alternately output from first excitation generator 22 and second excitation generator 26 to update the adaptive codebook, and outputs an adaptive codebook candidate alternately to first closed loop pitch searcher 12 and second closed loop pitch searcher 16. Gain codebook 29 stores pre-prepared quantized gains (adaptive code vector component and random code vector component) to output to first gain codebook searcher 14 and second gain codebook searcher 18.

Second closed loop pitch searcher 16 receives a second target vector, pitch of the first subframe, adaptive code vector candidates, and impulse response vector respectively input from second target calculator 6, first closed loop pitch searcher 12, adaptive codebook 19, and second impulse response calculator 27, performs the closed loop pitch search around the pitch of the first subframe, outputs closed loop pitch P2 to second pitch period processing filter 28 and the decoder, outputs the adaptive code vector to second excitation generator 26, and outputs a synthetic vector obtained by performing convolution of the second impulse response and the adaptive code vector to second target updator 17, second gain codebook searcher 18 and second filter state updator 11.

Second target updator 17 receives the second target vector and second adaptive code synthetic vector respectively input from second target calculator 6 and second closed loop pitch searcher 16, and calculates the target vector for the random codebook to output to second random codebook searcher 25. Second gain codebook searcher 18 receives the second target vector, second adaptive code synthetic vector and second random code synthetic vector respectively input from second target calculator 6, second closed loop pitch searcher 16 and second random codebook searcher 25, and selects an optimum quantized gain from gain codebook 29 to output to second excitation generator 26 and second filter state updator 11.

Second filter state updator 11 receives the second target vector, second adaptive code synthetic vector, second random code synthetic vector, and second quantized gain respectively input from second target calculator 6, second closed loop pitch searcher 16, second random codebook searcher 25, and second gain codebook searcher 18, updates the state of the synthesis filter, and outputs filter state st1.

Second impulse response calculator 27 receives as inputs a2 and qa2 that are respectively unquantized LPC and quantized LPC of the second subframe, and calculates the impulse response of the filter constructed by connecting the perceptual weighting filter and the synthesis filter, to output to second closed loop pitch searcher 16 and second pitch period processing filter 28. Second pitch period processing filter 28 receives a second closed loop pitch and second impulse response vector respectively input from second closed loop pitch searcher 16 and second impulse response calculator 27, and performs pitch period processing on the second impulse response vector to output to second random codebook searcher 25.

Second random codebook searcher 25 receives as inputs an updated second target vector output from second target updator 17, a period processed second impulse response vector output from second pitch period processing filter 28, and the random code vector candidates output from random codebook 24, selects an optimum random code vector from random codebook 24, outputs a vector obtained by performing the period processing on the selected random code vector to second excitation generator 26, outputs a synthetic vector obtained by performing convolution of the period processed second impulse response vector and the selected random code vector to second gain codebook searcher 18 and second filter state updator 11, and outputs code S2 representative of the selected random code vector to the decoder. Second excitation generator 26 receives the adaptive code vector, random code vector, and quantized gains respectively input from second closed loop pitch searcher 16, second random codebook searcher 25 and second gain codebook searcher 18, generates an excitation vector, and outputs the generated excitation vector to adaptive codebook 19.

In addition, LPC data L, pitches P1 and P2, random code vector data S1 and S2, and gain data G1 and G2 are coded to be bit streams, transmitted through the transmission path, and then output to the decoder. LPC data L is output from LPC quantizer 7. Pitch P1 is output from first closed loop pitch searcher 12. Random code vector data S1 is output from first random codebook searcher 23. Gain data G1 is output from first gain codebook searcher 14. Pitch P2 is output from second closed loop pitch searcher 16. Random code vector data S2 is output from second random codebook searcher 25. Gain data G2 is output from second gain codebook searcher 18. The processing on the second subframe is performed after all the processing on the first subframe is finished. The pitch differential value is quantized on the pitch of the second subframe using the pitch of the first subframe.

The following explains the operation of the CS-ACELP speech coding apparatus with the above-mentioned configuration with reference to FIG. 1. First, in FIG. 1, a speech signal is input to input buffer 1. Input buffer 1 updates an input digital speech signal to be coded per frame (10 ms) basis, and provides required buffering data to subframe divider 2, LPC analyzer 3 and weighted synthesis filter 4.

LPC analyzer 3 performs linear predictive analysis using data provided from input buffer 1, and calculates linear predictive coefficients (LPC) to output to LPC quantizer 7 and second LPC interpolator 8. LPC quantizer 7 converts the LPC into LSP to perform quantization, and outputs quantized LSP to first LPC interpolator 10. First LPC interpolator 10 adopts input quantized LSP as quantized LSP of the second subframe, and interpolates quantized LSP of the first subframe with linear interpolation using the quantized LSP of the second subframe of a last frame.

Obtained quantized LSP of the first and second subframes are converted into LPC, and respectively output as quantized LPC qa1 and qa2. Second LPC interpolator 8 converts input unquantized LPC into LSP, interpolates LSP of the first subframe in the same way as in first LPC interpolator 10, determines LSP of the first and second subframes to convert to LPC, and outputs a1 and a2 as unquantized LPC.

Weighted synthesis filter 4 receives a frame (10 ms) of a digital data sequence to be quantized from input buffer 1. Weighted synthesis filter 4, constructed with unquantized LPC a1 and a2, performs filtering on the frame data, and thereby calculates a weighted input speech signal to output to open loop pitch searcher 9.

Open loop pitch searcher 9 buffers previously generated weighted input speech signals, obtains a normalized autocorrelation function from a data sequence to which a newly generated weighted input speech signal is added, and based on the function, extracts a period of the weighted input speech signal. The extracted period is output to first closed loop pitch searcher 12.

Subframe divider 2 receives a frame of the digital signal sequence to be coded input from input buffer 1, divides the frame into two subframes, provides a first subframe (former subframe in time) to first target calculator 5, and further provides a second subframe (latter subframe in time) to second target calculator 6.

First target calculator 5 constructs a quantized synthesis filter and weighted synthesis filter using quantized LPC qa1 and unquantized LPC a1 of the first subframe, calculates a weighted input speech signal (target vector) from which a zero input response of the quantized synthesis filter is removed using filter state st1 obtained in second filter state updator 11 on the second subframe of the last frame, and outputs the target vector to first closed loop pitch searcher 12, first target vector updator 13, first gain codebook searcher 14 and first filter state updator 15.

First impulse response calculator 20 obtains an impulse response of the filter obtained by connecting the quantized synthesis filter constructed with quantized LPC qa1 and the weighted synthesis filter constructed with unquantized LPC a1 to output to first closed loop pitch searcher 12 and first pitch period processing filter 21. First closed loop pitch searcher 12 performs convolution of the first impulse response and the adaptive code vector retrieved from adaptive codebook 19, thereby calculates a weighted synthetic speech vector (adaptive codebook component), and extracts a pitch that generates such an adaptive code vector that minimizes an error between the calculated vector and the first target vector. The pitch search at this point is performed around the open loop pitch input from open loop pitch searcher 9.

The adaptive code vector generated with the obtained pitch is output to first excitation generator 22 to be used to generate an excitation vector, and a first adaptive code synthetic vector generated by performing the convolution of the impulse response and the adaptive code vector is output to first target updator 13, first gain codebook searcher 14, and first filter state updator 15. First target updator 13 subtracts the product, obtained by multiplying the first adaptive code synthetic vector output from first closed loop pitch searcher 12 by an optimum gain, from the first target vector output from first target calculator 5, thereby calculates a target vector for the first random codebook search, and outputs the calculated target vector to first random codebook searcher 23.

First random codebook searcher 23 performs convolution of the pitch period processed first impulse response, input from first pitch period processing filter 21, and the random code vector retrieved from random codebook 24, thereby calculates a weighted synthetic speech vector (random codebook component), and selects a random code vector that minimizes an error between the calculated vector and the target vector for the first random codebook. The selected random code vector is subjected to period processing by the pitch period processing filter, and output to first excitation generator 22 to be used in generating an excitation vector. Further the first random code synthetic vector generated by performing the convolution of the pitch period processed impulse response and the random code vector is output to first gain codebook searcher 14 and first filter state updator 15.

First pitch period processing filter 21 performs filtering on the impulse response input from first impulse response calculator 20 according to the following equation 1, and outputs the resultant to first random codebook searcher 23:

$$x(n)=x(n)+\beta\times x(n-T),\ n\geqq T \qquad \text{eq.1}$$

where x(n)is input data, n=0, 1, . . . , 39 (subframe length −1), T is pitch period, and β is pitch predictor gain.

Pitch period T used in this filter is P1 input from first closed loop pitch searcher 12. First gain codebook searcher 14 receives the first target vector, first adaptive code synthetic vector, and first random code synthetic vector respectively input from first target calculator 5, first closed loop pitch searcher 12 and first random codebook searcher 23, and selects a combination of a quantized adaptive code gain and quantized random code gain, which minimizes the square error between the first target vector and a vector of the sum of the first adaptive code synthetic vector multiplied by the quantized adaptive code gain and the first random code synthetic vector multiplied by the quantized random code gain, from gain codebook 29.

Selected quantized gains are output to first excitation generator 22 and first filter state updator 15 to be used in generation of the excitation vector and state update of the synthesis filter. First excitation generator 22 multiplies the adaptive code vector input from first closed loop pitch searcher 12, and the pitch period processed random code vector input from first random codebook searcher 23, respectively by the quantized gain (adaptive codebook component) and another quantized gain (random codebook component) input from first gain codebook searcher 14, and adds the adaptive code vector and random code vector each multiplied by the respective quantized gain to generate the excitation vector for the first subframe.

The generated first subframe excitation vector is output to the adaptive codebook to be used in update of the adaptive codebook. First filter state updator 15 updates the state of the filter constructed by connecting the quantized synthesis filter and weighted synthesis filter. The filter state is obtained by subtracting the sum of the adaptive code synthetic vector multiplied by the quantized gain (adaptive codebook component) and the random code synthetic vector multiplied by the another quantized gain (random codebook component) from the target vector input from first target calculator 5. The obtained filter state is output as st2, used as the filter state for the second subframe, and used in second target calculator 6.

Second target calculator 6 constructs the quantized synthesis filter and weighted synthesis filter using qa2 and a2 that are respectively the quantized LPC and unquantized LPC of the second subframe, calculates the weighted input speech signal (target vector) from which the zero input response of the quantized synthesis filter is removed using filter state st2 obtained in first filter state updator 15 on the first subframe, and outputs the second target vector to second closed loop pitch searcher 16, second target vector updator 17, second gain codebook searcher 25 and second filter state updator 11.

Second impulse response calculator 27 obtains the impulse response of the filter obtained by connecting the quantized synthesis filter constructed with quantized LPC qa2 and the weighted synthesis filter constructed with unquantized LPC a2 to output to second closed loop pitch searcher 16 and second pitch period processing filter 28. Second closed loop pitch searcher 16 performs the convolution of the second impulse response and the adaptive code vector retrieved from adaptive codebook 19, thereby calculates a weighted synthetic speech vector (adaptive codebook component), and extracts a pitch that generates such an adaptive code vector that minimizes an error between the calculated vector and the second target vector. The pitch search at this point is performed around pitch P1 of the first subframe input from first closed loop pitch searcher 12.

The adaptive code vector generated with the obtained pitch is output to second excitation generator 26 to be used to generate the excitation vector, and the second adaptive code synthetic vector generated by performing the convolution of the impulse response and the adaptive code vector is output to second target updator 17, second gain codebook searcher 18, and second filter state updator 11. Second target updator 17 subtracts the product, obtained by multiplying the second adaptive code synthetic vector output from second closed loop pitch searcher 16 by an optimum gain, from the second target vector output from second target calculator 6, thereby calculates the target vector for the second random codebook search, and outputs the calculated target vector to second random codebook searcher 25.

Second random codebook searcher 25 performs the convolution of the pitch period processed second impulse response input from second pitch period processing filter 28 and the random code vector retrieved from random codebook 24, thereby calculates a weighted synthetic speech vector (random codebook component), and selects a random code vector that minimizes an error between the calculated vector and the target vector for the second random codebook. The selected random code vector is subjected to period processing by the second pitch period processing filter, and output to second excitation generator 26 to be used in generating an excitation vector.

Further the second random code synthetic vector generated by performing the convolution of the pitch period processed impulse response and the random code vector is output to second gain codebook searcher 18 and second filter state updator 11. Second pitch period processing filter 28 performs filtering on the impulse response input from second impulse response calculator 27 according to the previously mentioned equation 1 where x(n)is input data, n=0, 1, . . . ,39(subframe length −1), T is pitch period, and $\beta$ is pitch predictor gain, and outputs the resultant to second random codebook searcher 25.

Pitch period T used in this filter is P2 input from second closed loop pitch searcher 16. Second gain codebook searcher 18 receives the second target vector, second adaptive code synthetic vector, and second random code synthetic vector respectively input from second target calculator 6, second closed loop pitch searcher 16 and second random codebook searcher 25, and selects a combination of a quantized adaptive code gain and quantized random code gain, which minimizes the square error between the second target vector and a vector of the sum of the second adaptive code synthetic vector multiplied by the quantized adaptive code gain and the second random code synthetic vector multiplied by the quantized random code gain, from gain codebook 29.

Selected quantized gains are output to second excitation generator 26 and second filter state updator 11 to be used in generation of the excitation vector and state update of the synthesis filter. Second excitation generator 26 multiplies the adaptive code vector input from second closed loop pitch searcher 16, and the pitch period processed random code vector input from second random codebook searcher 25, respectively by the quantized gain (adaptive codebook component) and another quantized gain (random codebook component) output from second gain codebook searcher 18, and adds the adaptive code vector and random code vector each multiplied by the respective quantized gain to generate the excitation vector for the second subframe. The generated second subframe excitation vector is output to adaptive codebook 19 to be used in update of the adaptive codebook.

Second filter state updator 11 updates the state of the filter constructed by connecting the quantized synthesis filter and weighted synthesis filter. The filter state is obtained by subtracting the sum of the adaptive code synthetic vector multiplied by the quantized gain (adaptive codebook component) and the random code synthetic vector multiplied by the another quantized gain (random codebook component) from the target vector output from second target calculator 6. The obtained filter state is output as st1, used as the filter state for the first subframe of a next frame, and used in first target calculator 5. In addition adaptive codebook 19 buffers excitation signals, generated in first excitation generator 22 and second excitation generator 26, sequentially in time, and stores the excitation signals generated previously with lengths required for the closed loop pitch search.

The update of the adaptive codebook is performed once for each subframe, while shifting a buffer corresponding to a subframe in the adaptive codebook, and then copying a newly generated excitation signal at the last portion of the buffer. In addition among the two signals divided in subframe divider 2 to be quantized, coding processing on the first subframe is first performed, and after the coding processing on the first subframe is completely finished, the coding processing on the second subframe is performed. Pitch P2 output on the second subframe is subjected to the quantization of the pitch differential value using pitch P1 output on the first subframe, and transmitted to a decoder side.

After the processing on one frame is finished, LPC data L, pitches P1 and P2, random code vector data S1 and S2, and gain data G1 and G2 are coded to be bit streams, transmitted through the transmission path, and then output to the decoder. LPC data L is output from LPC quantizer 7. Pitch P1 is output from first closed loop pitch searcher 12. Random code vector data S1 is output from first random codebook searcher 23. Gain data G1 is output from first gain codebook searcher 14. Pitch P2 is output from second closed loop pitch searcher 16. Random code vector data S2 is output from second random codebook searcher 25. Gain data G2 is output from second gain codebook searcher 18.

However in the above-mentioned conventional speech coding apparatus, since a single pitch candidate is only selected by the open loop pitch search, there is a problem that a pitch finally determined is not always an optimum one. To solve the problem, it is considered to output two or more pitch candidates, and perform the closed loop pitch search on the candidates. However in the above-mentioned coding apparatus, since the pitch differential value between subframes is quantized, there is another problem that an optimum pitch only for a first subframe may be selected.

DISCLOSURE OF INVENTION

It is an object of the present invention to improve accuracy of pitch search (adaptive codebook search) in a speech coding apparatus that performs quantization on a differential value of pitch information between subframes, without providing adverse effects on the quantization of pitch differential value.

It is a subject of the present invention to output a plurality of pitch candidates when a plurality of effective pitch candidates are present in the frame pitch search. That is, the present invention provides a CELP type speech coding apparatus provided with a pitch candidate selection section that performs preliminary selection of pitch for the adaptive codebook on a subframe, among the subframes obtained by dividing unit frame, on which the pitch differential value for the adaptive codebook is not quantized, and selects at least one pitch candidate adaptively.

BEST MODE FOR CARRYING OUT THE INVENTION

Embodiments of the present invention are specifically explained below with reference to accompanying drawings.

First Embodiment

Figure 3:
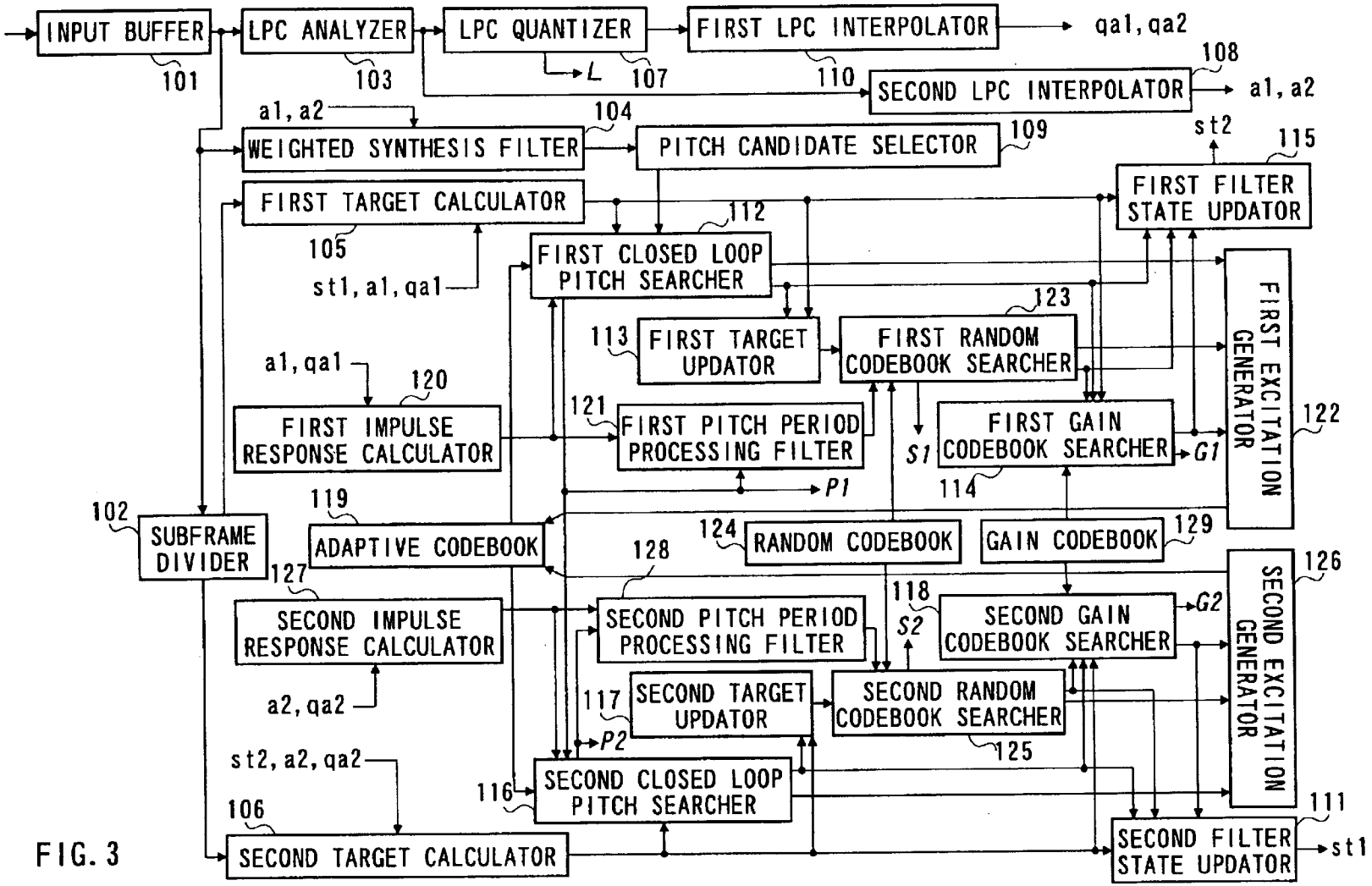
FIG. 3 is a block diagram illustrating a configuration of a speech coding apparatus according to a first embodiment of the present invention.

FIG. 3 is a block diagram illustrating a configuration of a speech coding apparatus according to the first embodiment of the present invention. In FIG. 3, input buffer 101 performs buffering of data with a length required for coding while updating an input digital speech signal for each frame, and outputs required data to subframe divider 102, LPC analyzer 103, and weighted synthesis filter 104.

Subframe divider 102 divides a frame of the input digital signal, input from input buffer 101, into two subframes, outputs a first subframe signal to first target calculator 105, and further outputs a second subframe signal to second target calculator 106. LPC analyzer 103 receives a digital speech signal required for analysis input from input buffer 101 to perform LPC analysis, and outputs linear predictive coefficients to LPC quantizer 107 and second LPC interpolator 108.

Weighted synthesis filter 104 receives the frame of the digital speech signal input from input buffer 101 and linear predictive coefficients a1 and a2 output from second LPC interpolator 108, and performs perceptual weighting on the input speech signal to output to pitch candidate selector 109. LPC quantizer 107 performs quantization on the linear predictive coefficients output from LPC analyzer 103, outputs quantized LPC to first LPC interpolator 110, and at the same time outputs coding data L of the quantized LPC to a decoder.

Second LPC interpolator 108 receives as inputs the LPC output from LPC analyzer 103, performs interpolation on LPC of the first subframe, and outputs the LPC of the first and second subframes respectively as a1 and a2. First LPC interpolator 110 receives as inputs the quantized LPC output from LPC quantizer 107, performs interpolation on the quantized LPC of the first subframe, and outputs quantized LPC of the first and second subframes respectively as qa1 and qa2. First target calculator 105 receives as inputs the first subframe of the digital speech signal divided in subframe divider 102, filter state st1 output from second filter state updator 111 on the last second subframe, and qa1 and al that are respectively the quantized LPC and unquantized LPC of the first subframe, and calculates a target vector to output to first closed loop pitch searcher 112, first target updator 113, first gain codebook searcher 114, and first filter state updator 115.

Second target calculator 106 receives as inputs the second subframe of the digital speech signal output from subframe divider 102, filter state st2 output from first filter state updator 115 on the first subframe of a current frame, and qa2 and a2 that are respectively the quantized LPC and unquantized LPC of the second subframe, and calculates a target vector to output to second closed loop pitch searcher 116, second target updator 117, second gain codebook searcher 118, and second filter state updator 111.

Pitch candidate selector 109 receives as an input a weighted input speech signal output from weighted synthesis filter 104 to extract a pitch periodicity, and outputs a pitch period candidate to first closed loop pitch searcher 112. First closed loop pitch searcher 112 receives a first target vector, pitch period candidate, adaptive code vector candidates, and an impulse response vector respectively input from first target calculator 105, pitch candidate selector 109, adaptive codebook 119, and first impulse response calculator 120, performs closed loop pitch search around each pitch candidate, outputs a closed loop pitch to second closed loop pitch searcher 116 and first pitch period processing filter 121, outputs an adaptive code vector to first excitation generator 122, and further outputs a synthetic vector obtained by performing convolution of the first impulse response and the adaptive code vector to first target updator 113, first gain codebook searcher 114, and first filter state updator 115.

First target updator 113 receives the first target vector and a first adaptive code synthetic vector respectively input from first target calculator 105 and first closed loop pitch searcher 112, and calculates a target vector for the random codebook to output to first random codebook searcher 123. First gain codebook searcher 114 receives the first target vector, the first adaptive code synthetic vector, and a first random code synthetic vector respectively input from first target calculator 105, first closed loop pitch searcher 112 and first random codebook searcher 123, and selects an optimum quantized gain from gain codebook 129 to output to first excitation generator 122 and first filter state updator 115.

First filter state updator 115 receives the first target vector, first adaptive code synthetic vector, first random code synthetic vector, and a first quantized gain respectively input from first target calculator 105, first closed loop pitch searcher 112, first random codebook searcher 123 and first gain codebook searcher 114, updates a state of a synthesis filter, and outputs filter state st2. First impulse response calculator 120 receives as inputs a1 and qa1 that are respectively unquantized LPC and quantized LPC of the first subframe, and calculates an impulse response of a filter constructed by connecting the perceptual weighting filter and the synthesis filter, to output to first closed loop pitch searcher 112 and first pitch period processing filter 121.

First pitch period processing filter 121 receives a first closed loop pitch and first impulse response vector respectively input from first closed loop pitch searcher 112 and first impulse response calculator 120, and performs pitch period processing on the first impulse response vector to output to first random codebook searcher 123. First random codebook searcher 123 receives an updated first target vector output from first target updator 113, a period processed first impulse response vector output from first pitch period processing filter 121, and random code vector candidates output from random codebook 124, selects an optimum random code vector from random codebook 124, outputs a vector obtained by performing period processing on the selected random code vector to first excitation generator 122, outputs a synthetic vector obtained by performing convolution of the period processed first impulse response vector and the selected random code vector to first gain codebook searcher 114 and first filter state updator 115, and outputs code S1 representative of the selected random code vector to a decoder.

Random codebook 124 stores a predetermined number of random code vectors with the predetermined shapes, and outputs a random code vector to first random codebook searcher 123 and second random codebook searcher 125. First excitation generator 122 receives the adaptive code vector, random code vector, and quantized gains respectively input from first closed loop pitch searcher 112, first random codebook searcher 123 and first gain codebook searcher 114, generates an excitation vector, and outputs the generated excitation vector to adaptive codebook 119.

Adaptive codebook 119 receives as an input the excitation vector alternately output from first excitation generator 122 and second excitation generator 126 to update the adaptive codebook, and outputs an adaptive codebook candidate alternately to first closed loop pitch searcher 112 and second closed loop pitch searcher 116. Gain codebook 129 stores pre-prepared quantized gains (adaptive code vector component and random code vector component) to output to first gain codebook searcher 114 and second gain codebook searcher 118.

Second closed loop pitch searcher 116 receives a second target vector, pitch of the first subframe, adaptive code vector candidates, and impulse response vector respectively input from second target calculator 106, first closed loop pitch searcher 112, adaptive codebook 119, and second impulse response calculator 127, performs closed loop pitch search around the pitch of the first subframe, outputs a closed loop pitch to second pitch period processing filter 128 and the decoder, outputs the adaptive code vector to second excitation generator 126, and outputs a synthetic vector obtained by performing convolution of the second impulse response and the adaptive code vector to second target updator 117, second gain codebook searcher 118 and second filter state updator 111.

Second target updator 117 receives the second target vector and second adaptive code synthetic vector respectively input from second target calculator 106 and second closed loop pitch searcher 116, and calculates the target vector for the random codebook to output to second random codebook searcher 125. Second gain codebook searcher 118 receives the second target vector, second adaptive code synthetic vector and second random code synthetic vector respectively input from second target calculator 106, second closed loop pitch searcher 116 and second random codebook searcher 125, and selects an optimum quantized gain from gain codebook 129 to output to second excitation generator 126 and second filter state updator 111.

Second filter state updator 111 receives the second target vector, second adaptive code synthetic vector, second random code synthetic vector, and second quantized gain respectively input from second target vector calculator 106, second closed loop pitch searcher 116, second random codebook searcher 125, and second gain codebook searcher 118, updates the state of the synthesis filter, and outputs filter state st1. Second impulse response calculator 127 receives as inputs a2 and qa2 that are respectively unquantized LPC and quantized LPC of the second subframe, and calculates the impulse response of the filter constructed by connecting the perceptual weighting filter and the synthesis filter, to output to second closed loop pitch searcher 116 and second pitch period processing filter 128.

Second pitch period processing filter 128 receives a second closed loop pitch and second impulse response vector respectively input from second closed loop pitch searcher 116 and second impulse response calculator 127, and performs pitch period processing on the second impulse response vector to output to second random codebook searcher 125. Second random codebook searcher 125 receives as inputs an updated second target vector output from second target updator 117, a period processed second impulse response vector output from second pitch period processing filter 128, and the random code vector candidates output from random codebook 124, selects an optimum random code vector from among random codebook 24, and outputs a vector obtained by performing the period processing on the selected random code vector to second excitation generator 126, outputs a synthetic vector obtained by performing convolution of the period processed second impulse response vector and the selected random code vector to second gain codebook searcher 118 and second filter state updator 111, and outputs code S2 representative of the selected random code vector to the decoder. Second excitation generator 126 receives the adaptive code vector, random code vector, and quantized gains respectively input from second closed loop pitch searcher 116, second random codebook searcher 125 and second gain codebook searcher 118, generates an excitation vector, and outputs the generated excitation vector to adaptive codebook 119.

In addition, LPC data L, pitches P1 and P2, random code vector data S1 and S2, and gain data G1 and G2 are coded to be bit streams, transmitted through the transmission path, and then output to the decoder. LPC data L is output from LPC quantizer 107. Pitch P1 is output from first closed loop pitch searcher 112. Random code vector data S1 is output from first random codebook searcher 123. Gain data G1 is output from first gain codebook searcher 114. Pitch P2 is output from second closed loop pitch searcher 116. Random code vector data S2 is output from second random codebook searcher 125. Gain data G2 is output from second gain codebook searcher 118. The processing on the second subframe is performed after all the processing on the first subframe is finished. The pitch differential value is quantized on pitch P2 of the second subframe using pitch P1 of the first subframe.

Figure 4:
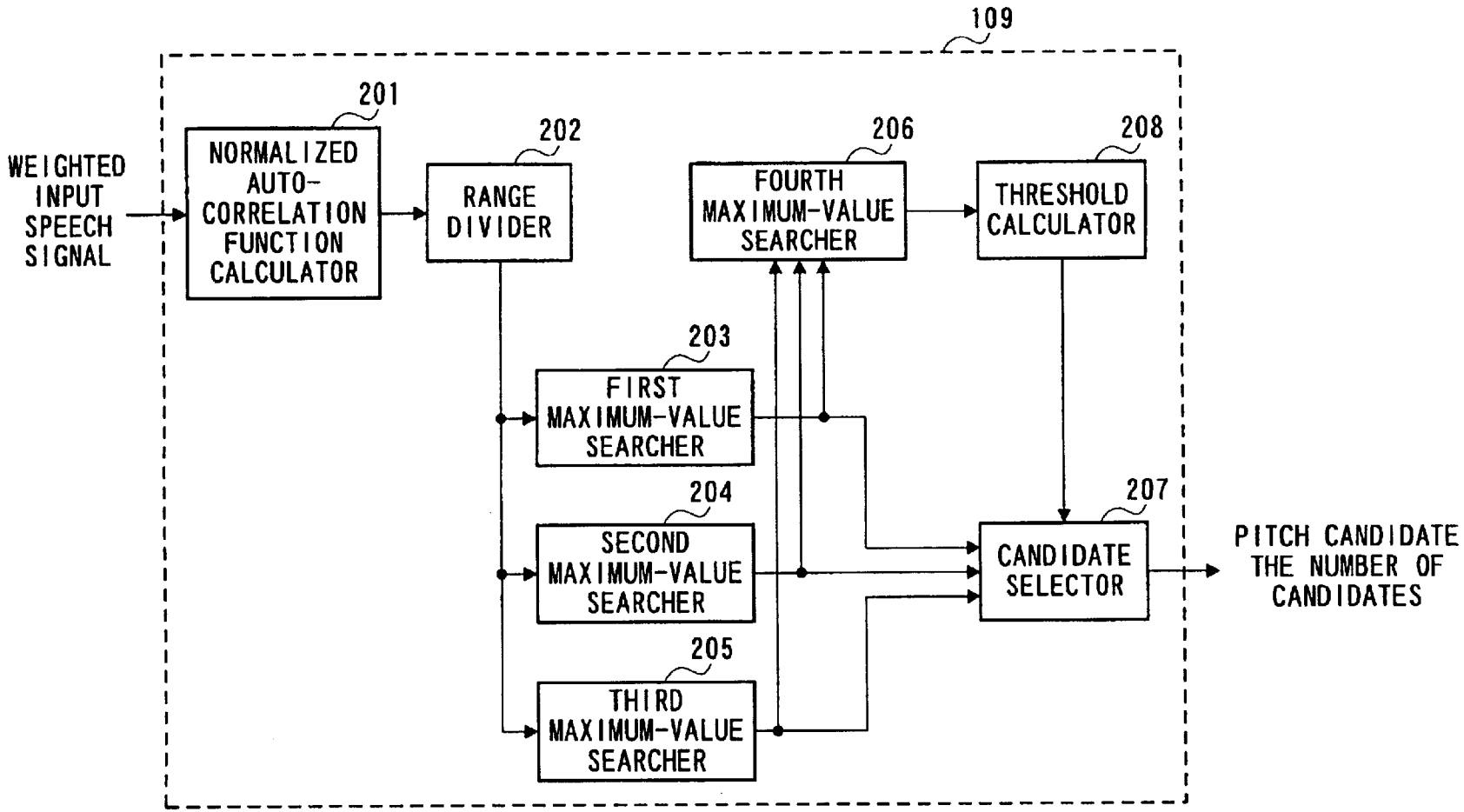
FIG. 4 is a block diagram illustrating a configuration of a pitch candidate selector in the above embodiment.
Figure 5:
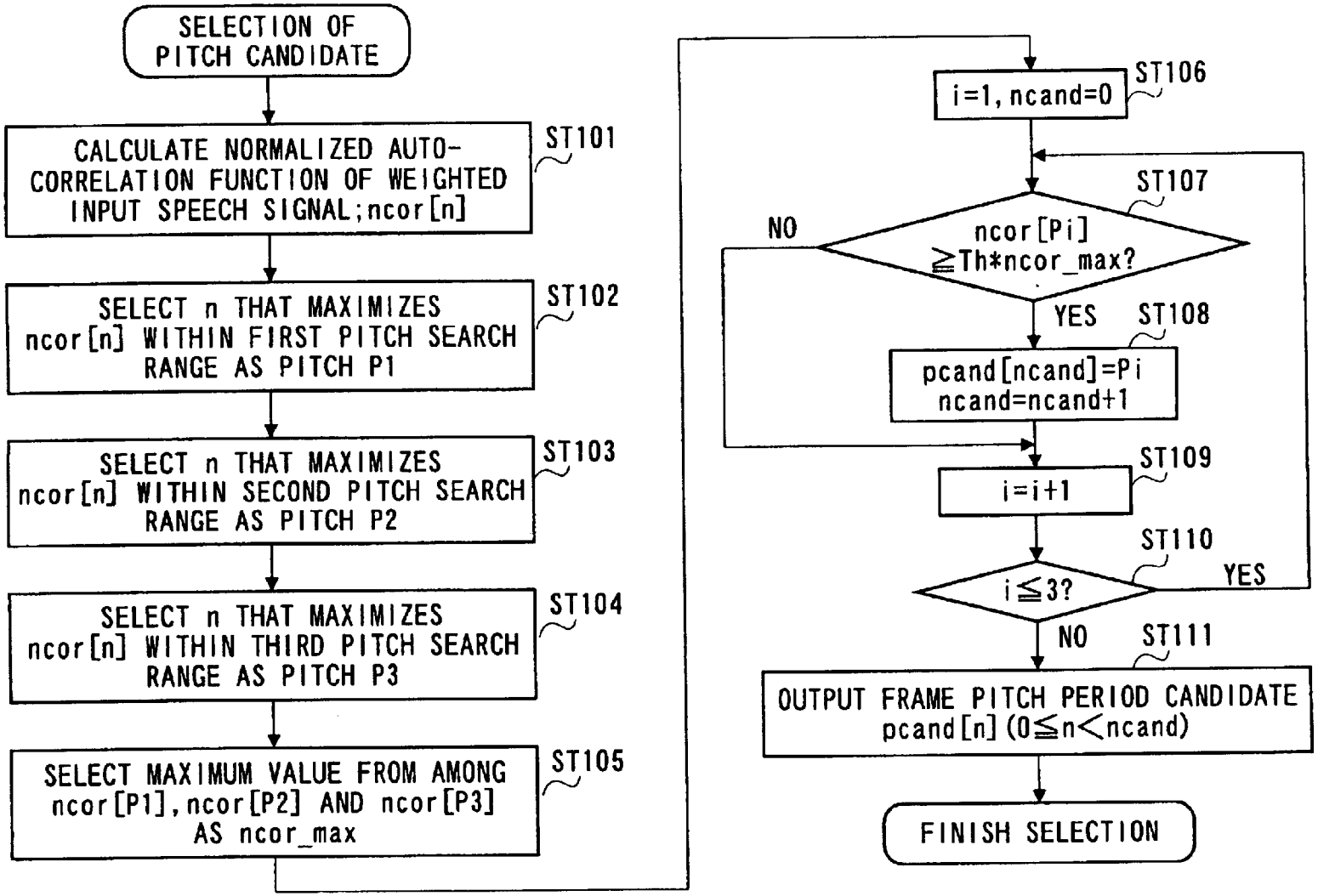
FIG. 5 is a flowchart illustrating processing in the pitch candidate selector in the above embodiment.

The following explains the operation of the speech coding apparatus with the above-mentioned configuration with reference to FIGS. 3 to 5. First, in FIG. 3, a speech signal is input to input buffer 101. Input buffer 101 updates an input digital speech signal to be coded per frame (10 ms) basis, and provides required buffering data to subframe divider 102, LPC analyzer 103 and weighted synthesis filter 104.

LPC analyzer 103 performs linear predictive analysis using data provided from input buffer 101, and calculates linear predictive coefficients (LPC) to output to LPC quantizer 107 and second LPC interpolator 108. LPC quantizer 107 converts the LPC into LSP to perform quantization, and outputs quantized LSP to first LPC interpolator 110. First LPC interpolator 110 adopts input quantized LSP as quantized LSP of the second subframe, and interpolates quantized LSP of the first subframe with linear interpolation using the quantized LSP of the second subframe of a last frame.

Obtained quantized LSP of the first and second subframes are converted into LPC, and respectively output as quantized LPC qa1 and qa2. Second LPC interpolator 108 converts input unquantized LPC into LSP, interpolates LSP of the first subframe in the same way as in first LPC interpolator 110, determines LSP of the first and second subframes to convert into LPC, and outputs a1 and a2 as unquantized LPC.

Weighted synthesis filter 104 receives a frame (10 ms) of a digital data sequence to be quantized input from input buffer 101. Weighted synthesis filter 104, constructed with unquantized LPC a1 and a2, performs filtering on the frame data, and thereby calculates a weighted input speech signal to output to pitch candidate selector 109.

Pitch candidate selector 109 buffers previously generated weighted input speech signals, obtains a normalized auto-correlation function from a data sequence to which a newly generated weighted input speech signal is added, and based on the function, extracts a period of the weighted input speech signal. At this point, pitch candidates are selected in descending order of the normalized auto-correlation function, and the number of the selected candidates is equal to or less than the predetermined number. The selection is performed using the normalized auto-correlation function in such a way that pitch candidates, each of which provides the normalized auto-correlation function equal to or more than a value obtained by multiplying a maximum value of the normalized auto-correlation function by a predetermined threshold coefficient (for example, 0.7), are output. ITU-T Recommendation G.729 adopts a method that separates a search range into three ranges in open loop pitch search, selects a candidate for each range, thereby selects total three candidates, and selects one candidate among the three candidates. However it is possible to design a constitution that selects at least one candidate up to three candidates among the above-mentioned three candidates with the above-mentioned selection method, and determines a final candidate in the closed loop pitch searcher. The selected pitch period candidate is output to first closed loop pitch searcher 112. A configuration of pitch candidate selector 109 will be described later using FIG. 4.

Subframe divider 102 receives a frame of the digital signal sequence to be coded input from the input buffer, divides the frame into two subframes, provides a first subframe (former subframe in time) to first target calculator 105, and further provides a second subframe (latter subframe in time) to second target calculator 106.

First target calculator 105 constructs a quantized synthesis filter and weighted synthesis filter using quantized LPC qa1 and unquantized LPC a1 of the first subframe, calculates a weighted input speech signal (target vector) from which a zero input response of the quantized synthesis filter is removed using filter state st1 obtained in filter state updator 111 on the second subframe of the last frame, and outputs the target vector to first closed loop pitch searcher 112, first target vector updator 113, first gain codebook searcher 114 and first filter state updator 115.

First impulse response calculator 120 obtains an impulse response of the filter obtained by connecting the quantized synthesis filter constructed with quantized LPC qa1 and the weighted synthesis filter constructed with unquantized LPC a1 to output to first closed loop pitch searcher 112 and first pitch period processing filter 121. First closed loop pitch searcher 112 performs convolution of a first impulse response and an adaptive code vector retrieved from adaptive codebook 119, thereby calculates a weighted synthetic speech vector (adaptive codebook component), and extracts a pitch that generates such an adaptive code vector that minimizes an error between the calculated vector and the first target vector. The pitch search at this point is performed only around the pitch candidate input from pitch candidate selector 109.

The adaptive code vector generated with the obtained pitch is output to first excitation generator 122 to be used to generate an excitation vector, and a first adaptive code synthetic vector generated by performing the convolution of the impulse response and adaptive code vector is output to first target updator 113, first filter state updator 115 and first gain codebook searcher 114. First target updator 113 subtracts the product, obtained by multiplying a first adaptive code synthetic vector output from first closed loop pitch searcher 112 by an optimum gain, from the first target vector output from first target calculator 105, thereby calculates a target vector for the first random codebook search, and outputs the calculated target vector to first random codebook searcher 123. First random codebook searcher 123 performs convolution of the pitch period processed first impulse response, input from first pitch period processing filter 121, and the random code vector retrieved from random codebook 124, thereby calculates a weighted synthetic speech vector (random codebook component), and selects a random code vector that minimizes an error between the calculated vector and the target vector for the first random codebook.

The selected random code vector is subjected to period processing by the pitch period processing filter, and output to first excitation generator 122 to be used in generating an excitation vector. Further the first random code synthetic vector generated by performing the convolution of the pitch period processed impulse response and the random code vector is output to first gain codebook searcher 114 and first filter state updator 115. First pitch period processing filter 121 performs filtering on the impulse response input from first impulse response calculator 120 according to the equation 1 described previously where x(n)is input data, n=0,1, . . . ,39(subframe length −1), T is pitch period, and β is pitch predictor gain, and outputs the resultant to first random codebook searcher 123. Pitch period T used in this filter is P1 input from first closed loop pitch searcher 112.

In addition β in the equation 1 is a quantized adaptive code gain (pitch gain) on the last subframe. First gain codebook searcher 114 receives the first target vector, first adaptive code synthetic vector, and first random code synthetic vector respectively input from first target calculator 105, first closed loop pitch searcher 112 and first random codebook searcher 123, and selects a combination of a quantized adaptive code gain and quantized random code gain, which minimizes the square error between the first target vector and a vector of the sum of the first adaptive code synthetic vector multiplied by the quantized adaptive code gain and the first random code synthetic vector multiplied by the quantized random code gain, from gain codebook 129.

Selected quantized gains are output to first excitation generator 122 and first filter state updator 115 to be used in generation of the excitation vector and state update of the synthesis filter. First excitation generator 122 multiplies the adaptive code vector input from first closed loop pitch searcher 112, and the pitch period processed random code vector input from first random codebook searcher 123, respectively by the quantized gain (adaptive codebook component) and another quantized gain (random codebook component) input from first gain codebook searcher 114, and adds the adaptive code vector and random code vector each multiplied by the respective quantized gain to generate the excitation vector for the first subframe.

The generated first subframe excitation vector is output to the adaptive codebook to be used in update of the adaptive codebook. First filter state updator 115 updates the state of the filter constructed by connecting the quantized synthesis filter and weighted synthesis filter. Specifically first filter state updator 115 multiplies the adaptive code synthetic vector output from first closed loop pitch searcher 112 by the quantized gain (adaptive codebook component) output from first gain codebook searcher 114, and further multiplies the random code synthetic vector output from first random codebook searcher 123 by the another quantized gain (random codebook component) output from first gain codebook searcher 114, to add. Then the updator 115 subtracts the obtained sum from the target vector input from first target calculator 105, and thereby obtains the filter state. The obtained filter state is output as st2, used as the filter state for the second subframe, and used in second target calculator 106.

Second target calculator 106 constructs the quantized synthesis filter and weighted synthesis filter using qa2 and a2 that are respectively the quantized LPC and unquantized LPC of the second subframe, calculates the weighted input speech signal (target vector) from which the zero input response of the quantized synthesis filter is removed using filter state st2 obtained in first filter state updator 115 on the first subframe, and outputs the second target vector to second closed loop pitch searcher 116, second target vector updator 117, second gain codebook searcher 118 and second filter state updator 111.

Second impulse response calculator 127 obtains the impulse response of the filter obtained by connecting the quantized synthesis filter constructed with quantized LPC qa2 and the weighted synthesis filter constructed with unquantized LPC a2 to output to second closed loop pitch searcher 116 and second pitch period processing filter 128. Second closed loop pitch searcher 116 performs the convolution of the second impulse response and the adaptive code vector retrieved from adaptive codebook 119, thereby calculates a weighted synthetic speech vector (adaptive codebook component), and extracts a pitch that generates such an adaptive code vector that minimizes an error between the calculated vector and the second target vector. The pitch search at this point is performed around pitch P1 of the first subframe input from first closed loop pitch searcher 112. The adaptive code vector generated with the obtained pitch is output to second excitation generator 126 to be used to generate an excitation vector, and a second adaptive code synthetic vector generated by performing the convolution of the impulse response and the adaptive code vector is output to second target updator 117, second filter state updator 111 and second gain codebook searcher 118.

Second target updator 117 subtracts the product, obtained by multiplying the second adaptive code synthetic vector output from second closed loop pitch searcher 116 by an optimum gain, from the second target vector output from second target calculator 106, thereby calculates a target vector for the second random codebook search, and outputs the calculated target vector to second random codebook searcher 125. Second random codebook searcher 125 performs convolution of the pitch period processed second impulse response input from second pitch period processing filter 128 and the random code vector retrieved from random codebook 124, thereby calculates a weighted synthetic speech vector (random codebook component), and selects a random code vector that minimizes an error between the calculated vector and the target vector for the second random codebook. The selected random code vector is subjected to period processing by the second pitch period processing filter, and output to second excitation generator 126 to be used in generating an excitation vector.

Further the second random code synthetic vector generated by performing the convolution of the pitch period processed impulse response and the random code vector is output to second gain codebook searcher 118 and second filter state updator 111. Second pitch period processing filter 128 performs filtering on the impulse response input from second impulse response calculator 127 according to the previously mentioned equation 1 where x(n)is input data, n=0, 1, . . . ,39(subframe length −1), T is pitch period, and β is pitch predictor gain, and outputs the resultant to second random codebook searcher 125. Pitch period T used in this filter is P2 input from second closed loop pitch searcher 116. Second gain codebook searcher 118 receives the second target vector, second adaptive code synthetic vector, and second random code synthetic vector respectively input from second target calculator 106, second closed loop pitch searcher 116 and second random codebook searcher 125, and selects a combination of a quantized adaptive code gain and quantized random code gain, which minimizes the square error between the second target vector and a vector of the sum of the second adaptive code synthetic vector multiplied by the quantized adaptive code gain and the second random code synthetic vector multiplied by the quantized random code gain, from gain codebook 129. Selected quantized gains are output to second excitation generator 126 and second filter state updator 111 to be used in generation of the excitation vector and state update of the synthesis filter.

Second excitation generator 126 multiplies the adaptive code vector input from second closed loop pitch searcher 116, and the pitch period processed random code vector input from second random codebook searcher 125, respectively by the quantized gain (adaptive codebook component) and another quantized gain (random codebook component) output from second gain codebook searcher 118, and adds the adaptive code vector and random code vector each multiplied by the respective quantized gain to generate the excitation vector for the second subframe. The generated second subframe excitation vector is output to the adaptive codebook to be used in update of the adaptive codebook. Second filter state updator 111 updates the state of the filter constructed by connecting the quantized synthesis filter and weighted synthesis filter.

Specifically second filter state updator 111 multiplies the adaptive code synthetic vector output from second closed loop pitch searcher 116 by the quantized gain (adaptive codebook component) output from second gain codebook searcher 118, and further multiplies the random code synthetic vector output from second random codebook searcher 125 by the another quantized gain (random codebook component) output from second gain codebook searcher 118, to add. Then the updator 111 subtracts the obtained sum from the target vector input from second target calculator 106, and thereby obtains the filter state. The obtained filter state is output as st1, used as the filter state for the first subframe of a next frame, and used in first target calculator 105. In addition adaptive codebook 119 buffers excitation signals, generated in first excitation generator 122 and second excitation generator 126, sequentially in time, and stores the excitation signals generated previously with lengths required for the closed loop pitch search.

The update of the adaptive codebook is performed once for each subframe, while shifting a buffer corresponding to a subframe in the adaptive codebook, and then copying a newly generated excitation signal at the last portion of the buffer. In addition among the two signals divided in subframe divider 102 to be quantized, coding processing on the first subframe is first performed, and after the coding processing on the first subframe is completely finished, the coding processing on the second subframe is performed. Pitch P2 of the second subframe is subjected to quantization of the pitch differential value using pitch P1 for the first subframe, and then transmitted to a decoder side.

After the processing on one frame is finished, LPC data L, pitches P1 and P2, random code vector data S1 and S2, and gain data G1 and G2 are coded to be bit streams, transmitted through the transmission path, and then output to the decoder. LPC data L is output from LPC quantizer 107. Pitch P1 is output from first closed loop pitch searcher 112. Random code vector data S1 is output from first random codebook searcher 123. Gain data G1 is output from first gain codebook searcher 114. Pitch P2 is output from second closed loop pitch searcher 116. Random code vector data S2 is output from second random codebook searcher 125. Gain data G2 is output from second gain codebook searcher 118.

Pitch candidate selector 109 is next explained specifically using FIG. 4. In FIG. 4, normalized auto-correlation function calculator 201 receives as an input the weighted input speech signal, calculates the normalized auto-correlation function of the signal , and outputs the resultant to range divider 202 that is a sorting section. Range divider 202 sorts the normalized auto-correlation functions into three ranges with pitch lag values to respectively output to first maximum-value searcher 203, second maximum-value searcher 204 and third maximum-value searcher 205.

First maximum-value searcher 203 receives as inputs first range auto-correlation functions sorted in range divider 202, outputs, among the inputs, a maximum value of the normalized auto-correlation function and a value of pitch lag that provides the maximum value to candidate selector 207, and further outputs the maximum value of the auto-correlation function to fourth maximum-value searcher 206. Second maximum-value searcher 204 receives as inputs second range auto-correlation functions sorted in range divider 202, outputs, among the inputs, a maximum value of the normalized auto-correlation function and a value of pitch lag that provides the maximum value to candidate selector 207, and further outputs the maximum value of the auto-correlation function to fourth maximum-value searcher 206. Third maximum-value searcher 205 receives as inputs third range auto-correlation functions sorted in range divider 202, outputs, among the inputs, a maximum value of the normalized auto-correlation function and a value of pitch lag that provides the maximum value to candidate selector 207, and further outputs the maximum value of the auto-correlation function to fourth maximum-value searcher 206.

Fourth maximum-value searcher 206 receives the maximum values of the normalized auto-correlation functions in respective ranges from first maximum-value searcher 203, second maximum-value searcher 204 and third maximum-value searcher 205, and outputs the largest maximum value among the inputs to threshold calculator 208. Threshold calculator 208 receives as an input the maximum value of the normalized auto-correlation function output from fourth maximum-value searcher 206, multiplies the maximum value by a threshold constant to calculate a threshold, and outputs the threshold to candidate selector 207. Candidate selector 207 receives the maximum values of the normalized auto-correlation functions in respective ranges and the pitch lags that provide respective maximum values from first maximum-value searcher 203, second maximum-value searcher 204 and third maximum-value searcher 205, selects only pitch lags that provide the normalized auto-correlation functions exceeding the threshold input from threshold calculator 208, and outputs the selected pitch lags and the number of such lags.

Current open loop pitch searcher 9 does not output a plurality of pitch candidates in a block corresponding to candidate selector 207, performs weighting on the maximum values of the normalized auto-correlation functions obtained in three ranges, and outputs only a single candidate. The weighting is to enable a range with a short pitch lag to tend to be selected, to prevent the occurrence of, for example, doubled pitch error. Such a weighting does not operate effectively on signals, for example, having two or more kinds of pitch periods. Further since the number of candidates is limited to one, there is a case that an optimum one as a pitch lag of the adaptive codebook is not always output.

To solve the above problem, in the present invention, a plurality of pitch candidates are output without performing the weighting processing, and a pitch is determined in the closed loop pitch search. It is thereby possible to select the optimum pitch among the adaptive codebook with respect to signals with two or more pitch periods. Further since it is possible to prevent a candidate with a correlation value that is not sufficiently high from being selected in calculating the auto-correlation, this method does not provide adverse effects on pitches of subframes on which the pitch differential value is quantified.

As a method of retaining a plurality of pitch candidates, it is considered to always retain a predetermined number of candidates. However such a case often causes a case that a pitch specialized for the first subframe is selected finally, and thereby the adverse effects are provided on the second subframe on which the pitch differential value is quantized. Therefore in the present invention, candidate selector 207 is provided not to output the candidate with the correlation value that is not sufficiently high in the case of calculating the auto-correlation in an entire frame. It is thereby intended not to output as a preliminary selection candidate a pitch specialized for a subframe on which the quantization on the pitch differential value is not applied. In addition in the case of performing the weighting to prevent the doubled pitch error, the weighting can be performed at the time a final pitch is determined in the closed loop pitch search. In addition while range divider 202 divides the range into three in FIG. 4, it may be possible to divide it into a number other than 3.

FIG. 5 is a flowchart illustrating processing contents in pitch candidate selector 109 illustrated in FIG. 4. In FIG. 5, first at step (hereinafter referred to as ST) 101, the normalized auto-correlation function of the weighted input signal; ncor[n],Pmin≦n≦Pmax (Pmin is a lower limit of the pitch search range, and Pmax is an upper limit of the pitch search range) is calculated.

Next at ST102, pitch lag P1 is obtained that provides the maximum value of the normalized auto-correlation function in the first range (Pmin≦n≦Pmax1, Pmax1 is an upper limit of the pitch in the first range). Next at ST103, pitch lag P2 is obtained that provides the maximum value of the normalized auto-correlation function in the second range (Pmax1<n≦Pmax2, Pmax2 is an upper limit of the pitch in the second range). Next at ST104, pitch lag P3 is obtained that provides the maximum value of the normalized auto-correlation function in the third range (Pmax2<n≦Pmax) is obtained. In addition the processing order of ST102, ST103 and ST104 is arbitrary.

After P1, P2 and P3 are obtained, at ST105, the maximum value is selected from among ncor[P1], ncor[P2] and ncor [P3] to be set at ncor_max. Next at ST106, loop counter i and pitch candidate number counter ncand are reset. Next at ST107, it is checked whether ncor[Pi] is equal to or more than threshold Th*ncor_max (Th is a constant to set the threshold), and when ncor[Pi] is equal to or more than the threshold, the processing of ST308 is performed, Pi is set to be a pitch candidate, and candidate number counter ncand is incremented. When ncor[Pi] is less than the threshold, ST308 is skipped. After the processing of ST108 is finished, at ST109, loop counter i is incremented. The loop counter is incremented similarly when the processing of ST308 is skipped.

After the loop counter is incremented at ST109, at ST110, it is checked whether the loop counter is indicative of 3 or less. When it is three or less, the processing flow is returned to ST107 to repeat the loop processing, and the processing with the threshold is performed on all the candidates obtained in the three ranges. At ST110, when the loop counter exceeds 3, the processing with the threshold is completed on all the candidates obtained in the three ranges, and the loop processing is finished. At ST311, the number of pitch candidates ncand and pitch candidate pcand[n];0 ≦n<ncand; are output, and thereby the pitch candidate selection processing is finished.

Figure 6:
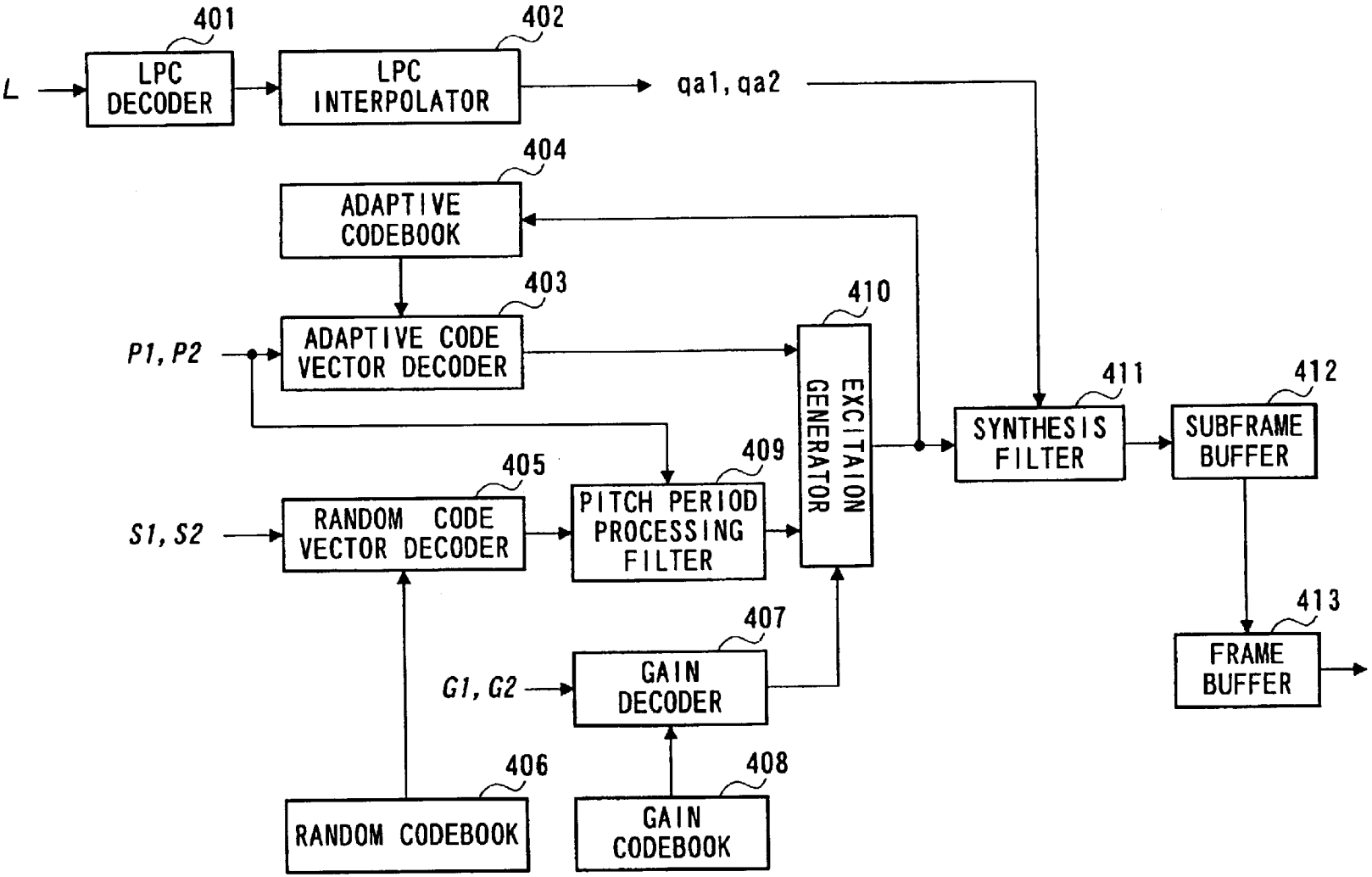
FIG. 6 is a block diagram illustrating a configuration of a speech decoding apparatus in the above embodiment.

Further FIG. 6 is a block diagram illustrating a decoding apparatus in the first embodiment of the present invention. The following explains the configuration and operation of the apparatus with reference to FIG. 6. In FIG. 6, LPC decoder 401 decodes the LPC from information L of the LPC transmitted from a coder side to output to LPC interpolator 402. LPC interpolator 402 receives the LPC output from LPC decoder 401 to interpolate, and outputs qa1 and qa2 that are respectively quantized (decoded) LPC of the first subframe and second subframe to synthesis filter 411. Adaptive code vector decoder 403 receives pitch information P1 and P2 respectively of the first subframe and second subframe transmitted from the coder side, and based on pitch P1 and P2, retrieves adaptive code vectors from adaptive codebook 404 to output to excitation generator 410.

Adaptive codebook 404 buffers the excitation vector output from excitation generator 410 while updating for each subframe, to output to adaptive code vector decoder 403. Random code vector decoder 405 receives random codebook information S1 and S2 respectively of the first and second subframes transmitted from the coder side, and retrieves random code vectors respectively corresponding to S1 and S2 from random codebook 406 to output to pitch period processing filter 409. Random codebook 404 stores the same contents as that in the coder side, and outputs the random code vector to the random code vector decoder. Gain decoder 407 receives gain information G1 and G2 respectively of the first and second subframes transmitted from the coder side, retrieves gains respectively corresponding to G1 and G2 from gain codebook 408, and decodes the quantized gains to output to excitation generator 410.

Gain codebook 408 stores the same contents as that in the coder side, and outputs the quantized gain to gain decoder 407. Pitch period processing filter 409 receives the random code vector output from the random code vector decoder and pitch information P1 and P2 transmitted from the coder side, and performs pitch period processing on the random code vector to output to excitation generator 410. Excitation generator 410 receives the adaptive code vector, pitch period processed random code vector and decoded gains respectively input from adaptive code vector decoder 403, pitch period processing filter 409 and gain decoder 407, and outputs a generated excitation vector to synthesis filter 411 and adaptive codebook 404.

Synthesis filter 411 is constructed with qa1 and qa2 output from LPC interpolator 402, and receives as a filter input the excitation vector output from excitation generator 410 to perform the filtering, and outputs a decoded speech signal to subframe buffer 412. Subframe buffer 412 stores the decoded speech signal corresponding to a single subframe output from synthesis filter 411, to output to frame buffer 413. Frame buffer 413 receives as an input the decoded speech signal corresponding to the single subframe output from subframe buffer 412, and stores the decoded signal corresponding to a frame (two subframes) to output.

The operation of the decoding apparatus with the above-mentioned configuration is explained with reference to FIG. 6. LPC information L transmitted from the coder side is decoded in LPC decoder 401. Interpolator 402 performs the same interpolation processing as in the coder side on decoded LPC, and obtains qa1 that is the quantized LPC of the first subframe and qa2 that is the quantized LPC of the second subframe. The qa1 is used to construct the synthesis filter for the first subframe, and qa2 is used to construct the synthesis filter for the second subframe.

Pitch information P1 and P2 respectively of the first and second subframes transmitted from the coder side is input to adaptive code vector decoder 403 and pitch period processing filter 409. First using P1, the adaptive code vector of the first subframe is retrieved from adaptive codebook 404, and output to excitation generator 410 as a decoded adaptive code vector. Random code information S1 and S2 respectively of the first and second subframes transmitted from the coder side is input to the random code vector decoder, and first using S1, the random code vector of the first subframe is retrieved from random codebook 406, and output to pitch period processing filter 409.

Pitch period processing filter 409 performs the pitch period processing on the random code vector with pitch period P1 in the same way as in the coder side based on the equation 1 previously described to output to excitation generator 410. Gain information G1 and G2 transmitted from the coder side is input to gain decoder 407, and first using G1, the gain of the first subframe is retrieved from gain codebook 408, and output to excitation generator 410. Excitation generator 410 adds a vector obtained by multiplying the adaptive code vector output from adaptive code vector decoder 403 by the adaptive code gain output from gain decoder 407, and another vector obtained by multiplying the pitch period processed random code vector output from pitch period processing filter 409 by the random code gain output from gain decoder 407, to output to the synthesis filter.

The decoded excitation vector output to the synthesis filter is concurrently output to adaptive codebook 404 also, and contained in the adaptive codebook used for a next subframe. Synthesis filter 411, constructed with qa1, receives as an input the decoded excitation vector output from excitation generator 410, and synthesizes a decoded speech for the first subframe to output to subframe buffer 412. Next the same speech decoding processing is performed using pitch information P2, random code information S2, gain information G2, and qa2 that are decoded LPC, each of the second subframe. Finally the decoded speech signals corresponding to two subframes (one frame) buffered in frame buffer 413 are output from the decoder, and thereby the decoding processing is finished on the one frame of the speech signal.

Thus according to the embodiment as described above, it is possible to achieve the speech coding apparatus and speech coding/decoding apparatus that retains one or more candidates in obtaining pitch candidates using input data including subframes on which the quantization of pitch differential value is performed, thereby achieves the pitch search with improved accuracy (as compared to the case that only one candidate is retained), and is capable of avoiding the risk, which is caused by retaining too more candidates, of selecting a pitch specialized for a subframe on which the quantization of pitch differential value is not performed.

Second Embodiment

Figure 7:
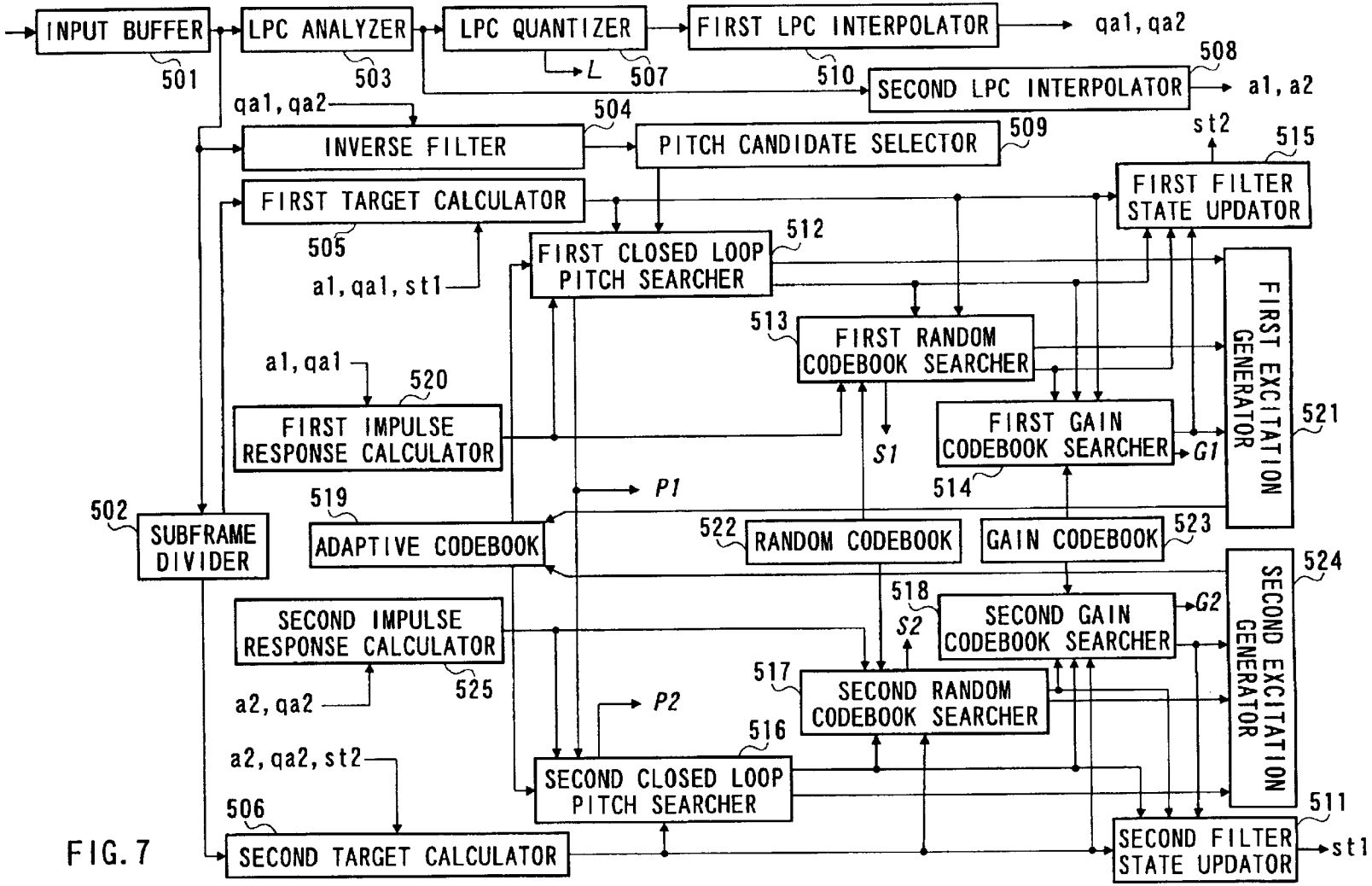
FIG. 7 is a block diagram illustrating a configuration of a speech coding apparatus according to a second embodiment of the present invention.

FIG. 7 is a block diagram illustrating a configuration of a speech coding apparatus according to the second embodiment of the present invention. This speech coding apparatus has such a configuration that the selection of pitch candidates is performed using a residual signal, not weighted input signal, and the pitch period processing on the random code vector is not performed.

In FIG. 7, input buffer 501 performs buffering of data with a length required for coding while updating an input digital speech signal for each frame, and outputs required data to subframe divider 502, LPC analyzer 503, and inverse filter 504. Subframe divider 502 divides a frame of the input digital signal, input from input buffer 501, into two subframes, outputs a first subframe signal to first target calculator 505, and further outputs a second subframe signal to second target calculator 506. LPC analyzer 503 receives a digital speech signal required for analysis input from input buffer 501 to perform LPC analysis, and outputs linear predictive coefficients to LPC quantizer 507 and second LPC interpolator 508.

Inverse filter 504 receives as inputs the frame of the digital speech signal input from input buffer 501 and linear predictive coefficients qa1 and qa2 output from first LPC interpolator 510, and performs inverse filtering processing on the input speech signal to output to pitch candidate selector 509. LPC quantizer 507 performs quantization on the linear predictive coefficients output from LPC analyzer 503, outputs quantized LPC to first LPC interpolator 510, and at the same time outputs coding data L of the quantized LPC to a decoder. Second LPC interpolator 508 receives as inputs the LPC output from LPC analyzer 503, performs interpolation on LPC of the first subframe, and outputs the LPC of the first and second subframes respectively as a1 and a2.

First LPC interpolator 510 receives as inputs quantized LPC output from LPC quantizer 507, performs interpolation on quantized LPC of the first subframe, and outputs the quantized LPC of the first and second subframes respectively as qa1 and qa2. First target calculator 505 receives as inputs the first subframe of the digital speech signal divided in subframe divider 502, filter state st1 output from second filter state updator 511 on the last second subframe, and qa1 and a1 that are respectively the quantized LPC and unquantized LPC of the first subframe, and calculates a first target vector output to first closed loop pitch searcher 512, first random codebook searcher 513, first gain codebook searcher 514, and first filter state updator 515.

Second target calculator 506 receives as inputs the second subframe of the digital speech signal output from subframe divider 502, filter state st2 output from first filter state updator 515 on the first subframe of a current frame, and qa2 and a2 that are respectively the quantized LPC and unquantized LPC of the second subframe, and calculates a second target vector to output to second closed loop pitch searcher 516, second random codebook searcher 517, second gain codebook searcher 518, and second filter state updator 511. Pitch candidate selector 509 receives as an input a residual signal output from inverse filter 504 to extract a pitch periodicity, and outputs a pitch period candidate to first closed loop pitch searcher 512.

First closed loop pitch searcher 512 receives a first target vector, pitch period candidate, adaptive code vector candidates, and an impulse response vector respectively input from first target calculator 505, pitch candidate selector 509, adaptive codebook 519, and first impulse response calculator 520, performs closed loop pitch search around each pitch candidate, outputs a closed loop pitch to second closed loop pitch searcher 516 and the decoder, outputs an adaptive code vector to first excitation generator 522, and further outputs a synthetic vector obtained by performing convolution of the first impulse response and the adaptive code vector to first random codebook searcher 513, first gain codebook searcher 514, and first filter state updator 515. First random codebook searcher 513 receives the first target vector, a first adaptive code synthetic vector, and first impulse response vector respectively input from first target calculator 505, first closed loop pitch searcher 512 and first impulse response calculator 520, further receives random code vector candidates output from random codebook 522, selects an optimum random code vector among from random codebook 522, outputs the selected random code vector to first excitation generator 521, outputs a synthetic vector obtained by performing convolution of the selected random code vector and first impulse response vector to first gain codebook searcher 514 and first filter state updator 515, and further outputs code S1 representative of the selected random code vector to the decoder.

First gain codebook searcher 514 receives the first target vector, the first adaptive code synthetic vector, and a first random code synthetic vector respectively input from first target calculator 505, first closed loop pitch searcher 512 and first random codebook searcher 523, and selects an optimum quantized gain from gain codebook 523 to output to first excitation generator 521 and first filter state updator 515. First filter state updator 515 receives the first target vector, first adaptive code synthetic vector, first random code synthetic vector, and a first quantized gain respectively input from first target calculator 505, first closed loop pitch searcher 512, first random codebook searcher 513 and first gain codebook searcher 514, updates a state of the synthesis filter, and outputs filter state st2. First impulse response calculator 520 receives as inputs a1 and qa1 that are respectively LPC and quantized LPC of the first subframe, and calculates an impulse response of a filter constructed by connecting the perceptual weighting filter and the synthesis filter, to output to first closed loop pitch searcher 512 and first random codebook searcher 513.

Random codebook 522 stores a predetermined number of random code vectors with the predetermined shapes, and outputs a random code vector to first random codebook searcher 513 and second random codebook searcher 517. First excitation generator 521 receives the adaptive code vector, random code vector, and quantized gains respectively input from first closed loop pitch searcher 512, first random codebook searcher 513 and first gain codebook searcher 514, generates an excitation vector, and outputs the generated excitation vector to adaptive codebook 519.

Adaptive codebook 519 receives as an input the excitation vector alternately output from first excitation generator 521 and second excitation generator 524 to update the adaptive codebook, and outputs an adaptive codebook candidate alternately to first closed loop pitch searcher 512 and second closed loop pitch searcher 516. Gain codebook 523 stores pre-prepared quantized gains (adaptive code vector component and random code vector component) to output to first gain codebook searcher 514 and second gain codebook searcher 518.

Second closed loop pitch searcher 516 receives a second target vector, pitch of the first subframe, adaptive code vector candidates, and an impulse response vector respectively input from second target calculator 506, first closed loop pitch searcher 512, adaptive codebook 519, and second impulse response calculator 527, performs closed loop pitch search around the pitch of the first subframe, outputs a closed loop pitch as P2 to the decoder (at this point, the quantization of the pitch differential value is performed on P1 using P2,and then P2 is transmitted to a decoder side), outputs the adaptive code vector to second excitation generator 524, and outputs a synthetic vector obtained by performing convolution of the second impulse response and the adaptive code vector to second random codebook searcher 517, second gain codebook searcher 518 and second filter state updator 511.

Second gain codebook searcher 518 receives the second target vector, second adaptive code synthetic vector and second random code synthetic vector respectively input from second target calculator 506, second closed loop pitch searcher 516 and second random codebook searcher 517, and selects an optimum quantized gain from the gain codebook to output to second excitation generator 524 and second filter state updator 511. Second filter state updator 511 receives the second target vector, second adaptive code synthetic vector, second random code synthetic vector, and second quantized gain respectively input from second target vector calculator 506, second closed loop pitch searcher 516, second random codebook searcher 517, and second gain codebook searcher 518, updates the state of the synthesis filter, and outputs filter state st1.

Second impulse response calculator 525 receives as inputs a2 and qa2 that are respectively LPC and quantized LPC of the second subframe, and calculates the impulse response of the filter constructed by connecting the perceptual weighting filter and the synthesis filter, to output to second closed loop pitch searcher 516 and second random codebook searcher 517. Second random codebook searcher 517 receives as inputs the second target vector output from second target calculator 506, a second adaptive code synthetic vector output from second closed loop pitch searcher 516, second impulse response vector output from second impulse response calculator 525, and random code vector candidates output from random codebook 522, selects an optimum random code vector from among random codebook 522, outputs the selected random code vector to second excitation generator 524, outputs a synthetic vector obtained by performing convolution of the selected random code vector and second impulse response vector to second gain codebook searcher 518 and second filter state updator 511, and further outputs code S1 representative of the selected random code vector to the decoder. Second excitation generator 524 receives the adaptive code vector, random code vector, and quantized gain respectively input from second closed loop pitch searcher 516, second random codebook searcher 517 and second gain codebook searcher 518, generates an excitation vector, and outputs the generated excitation vector to adaptive codebook 519.

In addition, LPC data L, pitches P1 and P2, random code vector data S1 and S2, and gain data G1 and G2 are coded to be bit streams, transmitted through the transmission path, and then output to the decoder (the pitch differential value is quantized on P2 using P1). LPC data L is output from LPC quantizer 507. Pitch P1 is output from first closed loop pitch searcher 512. Random code vector data S1 is output from first random codebook searcher 513. Gain data G1 is output from first gain codebook searcher 514. Pitch P2 is output from second closed loop pitch searcher 516. Random code vector data S2 is output from second random codebook searcher 517. Gain data G2 is output from second gain codebook searcher 518. The processing on the second subframe is performed after all the processing on the first subframe is finished.

Figure 8:
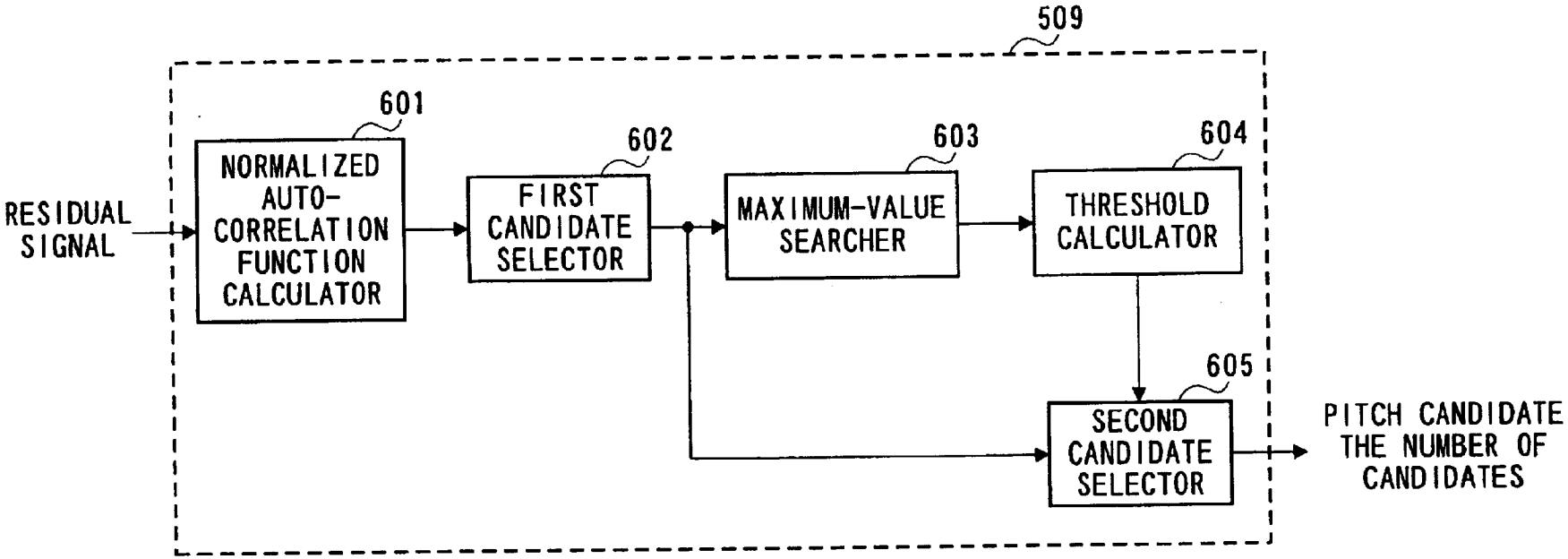
FIG. 8 is a block diagram illustrating a configuration of a pitch candidate selector in the above embodiment.
Figure 9:
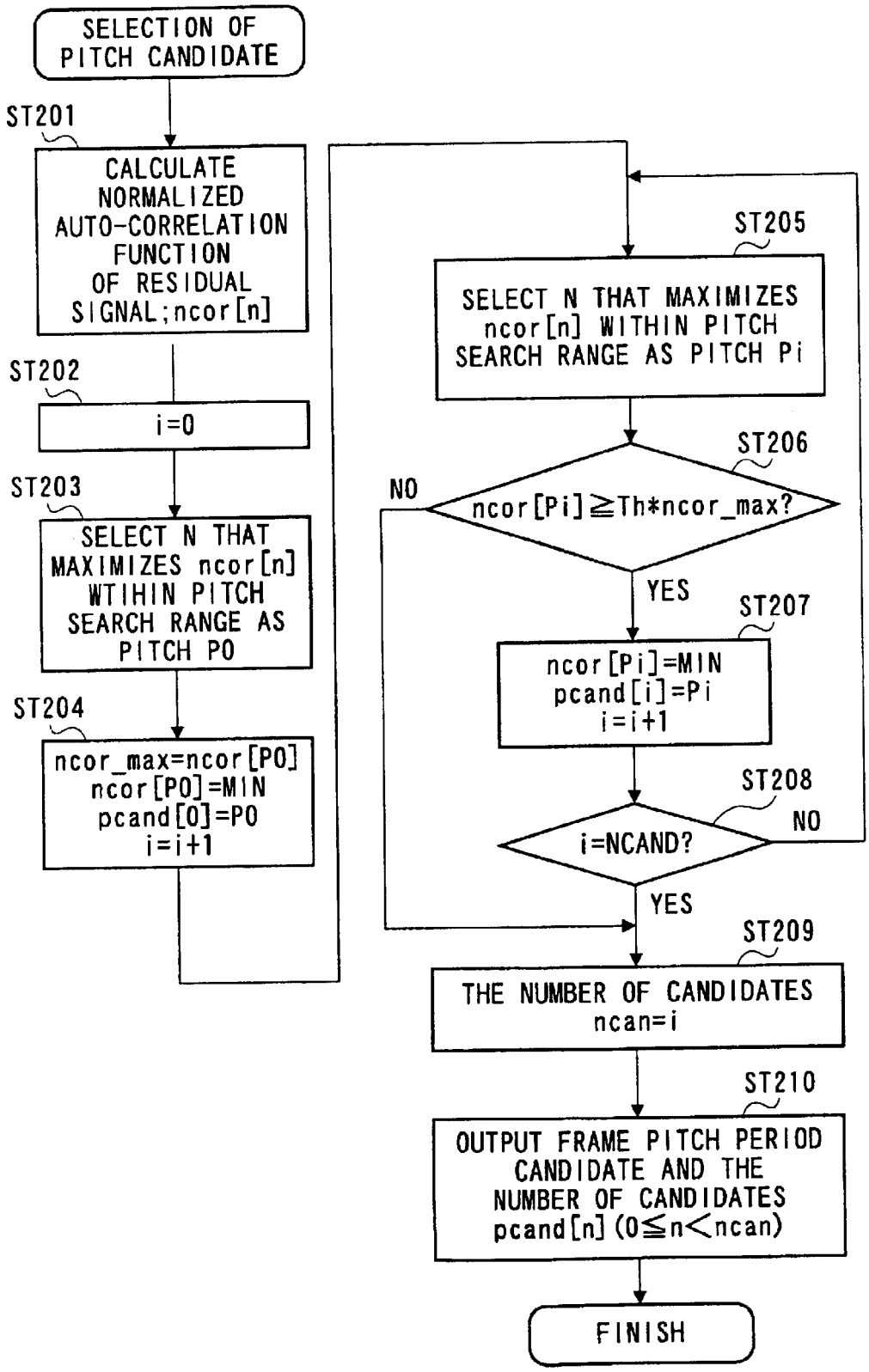
FIG. 9 is a flowchart illustrating processing in the pitch candidate selector in the above embodiment.

The following explains the operation of the speech coding apparatus with the above-mentioned configuration with reference to FIGS. 7 to 9. First, in FIG. 7, a speech signal is input to input buffer 501. Input buffer 501 updates an input digital speech signal to be coded per frame (10 ms) basis, and provides required buffering data to subframe divider 502, LPC analyzer 503 and inverse filter 104. LPC analyzer 503 performs linear predictive analysis using data provided from input buffer 501, and calculates linear predictive coefficients (LPC) to output to LPC quantizer 507 and second LPC interpolator 508.

LPC quantizer 507 converts the LPC into LSP to perform quantization, and outputs quantized LSP to first LPC interpolator 510. First LPC interpolator 510 adopts input quantized LSP as quantized LSP of the second subframe, interpolates the quantized LSP of the second subframe of a last frame and the quantized LSP of the second subframe of a current frame with linear interpolation, and thereby obtains quantized LSP of the first subframe. Obtained quantized LSP of the first and second subframes are converted into LPC, and respectively output as quantized LPC qa1 and qa2. Second LPC interpolator 508 converts input unquantized LPC into LSP, interpolates LSP of the first subframe in the same way as in first LPC interpolator 510, determines LSP of the first and second subframes to convert into LPC, and outputs a1 and a2 as unquantized LPC.

Inverse filter 504 receives as an input a frame (10 ms) of a digital data sequence to be quantized from input buffer 501. Inverse filter 504, constructed with quantized LPC qa1 and qa2, performs filtering on the frame data, and thereby calculates a residual signal to output to pitch candidate selector 509. Pitch candidate selector 509 buffers previously generated residual signals, obtains a normalized auto-correlation function from a data sequence to which a newly generated residual signal is added, and based on the function, extracts a period of the residual signal. At this point, pitch candidates are selected in descending order of the normalized auto-correlation function, and the number of the selected candidates is equal to or less than the predetermined number. The selection is performed using the normalized auto-correlation function in such a way that pitch candidates, each of which provides the normalized auto-correlation function equal to or more than a value obtained by multiplying a maximum value of the normalized auto-correlation function by a predetermined threshold coefficient (for example, 0.7), are output. The selected pitch period candidate is output to first closed loop pitch searcher 512. A configuration of this pitch candidate selector will be described later using FIG. 8.

Subframe divider 502 receives a frame of the digital signal sequence to be coded input from the input buffer, divides the frame into two subframes, provides a first subframe (former subframe in time) to first target calculator 505, and further provides a second subframe (latter subframe in time) to second target calculator 506.

First target calculator 505 constructs a quantized synthesis filter and weighted synthesis filter using quantized LPC qa1 and unquantized LPC a1 of the first subframe, calculates a weighted input speech signal (first target vector) from which a zero input response of the quantized synthesis filter is removed using filter state st1 obtained in filter state updator 511 on the second subframe of the last frame, and outputs the first target vector to first closed loop pitch searcher 512, first random codebook searcher 513, first gain codebook searcher 514 and first filter state updator 515.

First impulse response calculator 520 obtains an impulse response of the filter obtained by connecting the quantized synthesis filter constructed with quantized LPC qa1 and the weighted synthesis filter constructed with unquantized LPC a1 to output to first closed loop pitch searcher 512 and first random codebook searcher 513. First closed loop pitch searcher 512 performs convolution of a first impulse response and an adaptive code vector retrieved from adaptive codebook 519, thereby calculates a weighted synthetic speech vector (adaptive codebook component), and extracts a pitch that generates such an adaptive code vector that minimizes an error between the calculated vector and the first target vector. The pitch search at this point is performed around the pitch candidate input from pitch candidate selector 109, and a pitch is selected from the pitch candidate(s).

The adaptive code vector generated with the obtained pitch is output to first excitation generator 521 to be used to generate an excitation vector, and a first adaptive code synthetic vector generated by performing convolution of the impulse response and the adaptive code vector is output to first random codebook searcher 513, first filter state updator 515 and first gain codebook searcher 514. First random codebook searcher 513 performs convolution of the random code vector retrieved from random codebook 522 and the first impulse response input from first impulse response calculator 520, thereby calculates a weighted synthetic speech vector (random codebook component), and selects a random code vector that minimizes an error between the calculated vector and the first target vector when used in combination with the first adaptive code synthetic vector.

The selected random code vector is output to first excitation generator 521 to be used in generating an excitation vector. Further the first random code synthetic vector generated by performing the convolution of the first impulse response and random code vector is output to first gain codebook searcher 514 and first filter state updator 515. First gain codebook searcher 514 receives the first target vector, first adaptive code synthetic vector, and first random code synthetic vector respectively input from first target calculator 505, first closed loop pitch searcher 512 and first random codebook searcher 513, and selects a combination of a quantized adaptive code gain and quantized random code gain, which minimizes the square error between the first target vector and a vector of the sum of the first adaptive code synthetic vector multiplied by the quantized adaptive code gain and the first random code synthetic vector multiplied by the quantized random code gain, from gain codebook 523.

Selected quantized gains are output to first excitation generator 521 and first filter state updator 515 to be used in generation of the excitation vector and state update of the synthesis filter. First excitation generator 521 multiplies the adaptive code vector input from first closed loop pitch searcher 512, and the random code vector input from first random codebook searcher 514, respectively by the quantized gain (adaptive codebook component) and another quantized gain (random codebook component) input from first gain codebook searcher 514, and adds the adaptive code vector and random code vector each multiplied by the respective quantized gain to generate the excitation vector for the first subframe.

The generated first subframe excitation vector is output to the adaptive codebook to be used in update of the adaptive codebook. First filter state updator 515 updates the state of the filter constructed by connecting the quantized synthesis filter and weighted synthesis filter. Specifically first filter state updator 515 multiplies the adaptive code synthetic vector output from first closed loop pitch searcher 512 by the quantized gain (adaptive codebook component) output from first gain codebook searcher 514, and further multiplies the random code synthetic vector output from first random codebook searcher 513 by the another quantized gain (random codebook component) output from first gain codebook searcher 514, to add. Then the updator 115 subtracts the obtained sum from the target vector input from first target calculator 515, and thereby obtains the filter state. The obtained filter state is output as st2, used as the filter state for the second subframe, and used in second target calculator 506.

Second target calculator 506 constructs the quantized synthesis filter and weighted synthesis filter using qa2 and a2 that are respectively the quantized LPC and unquantized LPC of the second subframe, calculates a weighted input speech signal (second target vector) from which a zero input response of the quantized synthesis filter is removed using filter state st2 obtained in first filter state updator 515 on the first subframe, and outputs the second target vector to second closed loop pitch searcher 516, second random codebook searcher 517, second gain codebook searcher 518 and second filter state updator 511.

Second impulse response calculator 525 obtains an impulse response of the filter obtained by connecting the quantized synthesis filter constructed with quantized LPC qa2 and the weighted synthesis filter constructed with unquantized LPC a2 to output to second closed loop pitch searcher 516 and second random codebook searcher 517. Second closed loop pitch searcher 516 performs convolution of a second impulse response and the adaptive code vector retrieved from adaptive codebook 519, and thereby calculates a weighted synthetic speech vector (adaptive codebook component), and extracts a pitch that generates such an adaptive code vector that minimizes an error between the calculated vector and the second target vector. The pitch search at this point is performed only around pitch P1 of the first subframe input from first closed loop pitch searcher 512.

The adaptive code vector generated with the obtained pitch is output to second excitation generator 524 to be used to generate an excitation vector, and a second adaptive code synthetic vector generated by performing convolution of the impulse response and adaptive code vector is output to second random codebook searcher 517, second filter state updator 511 and second gain codebook searcher 518. Second random codebook searcher 517 performs convolution of the second impulse response input from second impulse response calculator 525 and the random code vector retrieved from random codebook 522, thereby calculates a weighted synthetic speech vector (random codebook component), and selects a random code vector that minimizes an error between the calculated vector and the second target vector when used in combination with the second adaptive code synthetic vector.

The selected random code vector is output to second excitation generator 524 to be used in generating an excitation vector. Further the second random code synthetic vector generated by performing the convolution of the second impulse response and the random code vector is output to second gain codebook searcher 518 and second filter state updator 511. Second gain codebook searcher 518 receives the second target vector, second adaptive code synthetic vector, and second random code synthetic vector respectively input from second target calculator 506, second closed loop pitch searcher 516 and second random codebook searcher 517, and selects a combination of a quantized adaptive code gain and quantized random code gain, which minimizes the square error between the second target vector and a vector of the sum of the second adaptive code synthetic vector multiplied by the quantized adaptive code gain and the second random code synthetic vector multiplied by the quantized random code gain, from gain codebook 523.

Selected quantized gains are output to second excitation generator 524 and second filter state updator 511 to be used in generation of the excitation vector and state update of the synthesis filter. Second excitation generator 524 multiplies the adaptive code vector input from second closed loop pitch searcher 516, and the random code vector input from second random codebook searcher 525, respectively by the quantized gain (adaptive codebook component) and another quantized gain (random codebook component) output from second gain codebook searcher 518, and adds the adaptive code vector and random code vector each multiplied by the respective quantized gain to generate the excitation vector for the second subframe. The generated second subframe excitation vector is output to adaptive codebook 519 to be used in update of adaptive codebook 519.

Second filter state updator 511 updates the state of the filter constructed by connecting the quantized synthesis filter and weighted synthesis filter. Specifically second filter state updator 511 multiplies the adaptive code synthetic vector output from second closed loop pitch searcher 516 by the quantized gain (adaptive codebook component) output from second gain codebook searcher 518, and further multiplies the random code synthetic vector output from second random codebook searcher 517 by the another quantized gain (random codebook component) output from second gain codebook searcher 518, to add. Then the updator 511 subtracts the obtained sum from the target vector input from second target calculator 506, and thereby obtains the filter state. The obtained filter state is output as st1, used as the filter state for the first subframe of a next frame, and used in first target calculator 505.

In addition adaptive codebook 519 buffers excitation signals, generated in first excitation generator 521 and second excitation generator 524, sequentially in time, and stores the excitation signals generated previously with lengths required for the closed loop pitch search. The update of the adaptive codebook is performed once for each subframe, while shifting a buffer corresponding to a subframe in the adaptive codebook, and then copying a newly generated excitation signal at the last portion of the buffer. In addition among the signals divided in subframe divider 502 to be quantized, coding processing on the first subframe is first performed, and after the coding processing on the first subframe is completely finished, the coding processing on the second subframe is performed. Pitch P2 of the second subframe is subjected to the quantization of pitch differential value using pitch P1 of the first subframe.

After the processing on one frame is finished, LPC data L, pitches P1 and P2, random code vector data S1 and S2, and gain data G1 and G2 are coded to be bit streams, transmitted through the transmission path, and then output to the decoder. LPC data L is output from LPC quantizer 507. Pitch P1 is output from first closed loop pitch searcher 512. Random code vector data S1 is output from first random codebook searcher 513. Gain data G1 is output from first gain codebook searcher 514. Pitch P2 is output from second closed loop pitch searcher 516. Random code vector data S2 is output from second random codebook searcher 517. Gain data G2 is output from second gain codebook searcher 518.

Pitch candidate selector 509 is next explained specifically using FIG. 8. In FIG. 8, normalized auto-correlation function calculator 601 receives an input the residual signal, calculates the normalized auto-correlation function of the signal, and outputs the resultant to first candidate selector 602. First candidate selector 602 outputs as pitch candidates a predetermined number (for example, NCAND) of the normalized auto-correlation functions in descending order in a pitch search range among the functions output from normalized auto-correlation function calculator 601 to maximum-value searcher 603 and second candidate selector 605.

Maximum-value searcher 603 outputs a maximum value of the normalized auto-correlation function among NCAND functions output from first candidate selector 602 in descending order (a value that is the maximum value of the normalized auto-correlation function in the pitch search range) to threshold calculator 604. Threshold calculator 604 multiplies the maximum value of the normalized auto-correlation function output from maximum-value searcher 603 by a predetermined threshold constant Th to output to second candidate selector 605. Second candidate selector 605 selects only pitch candidate(s) that provide the normalized auto-correlation functions exceeding a threshold output from threshold calculator 604 among the NCAND candidates output from first candidate selector 602, to output as pitch candidate(s) .

Figure 1:
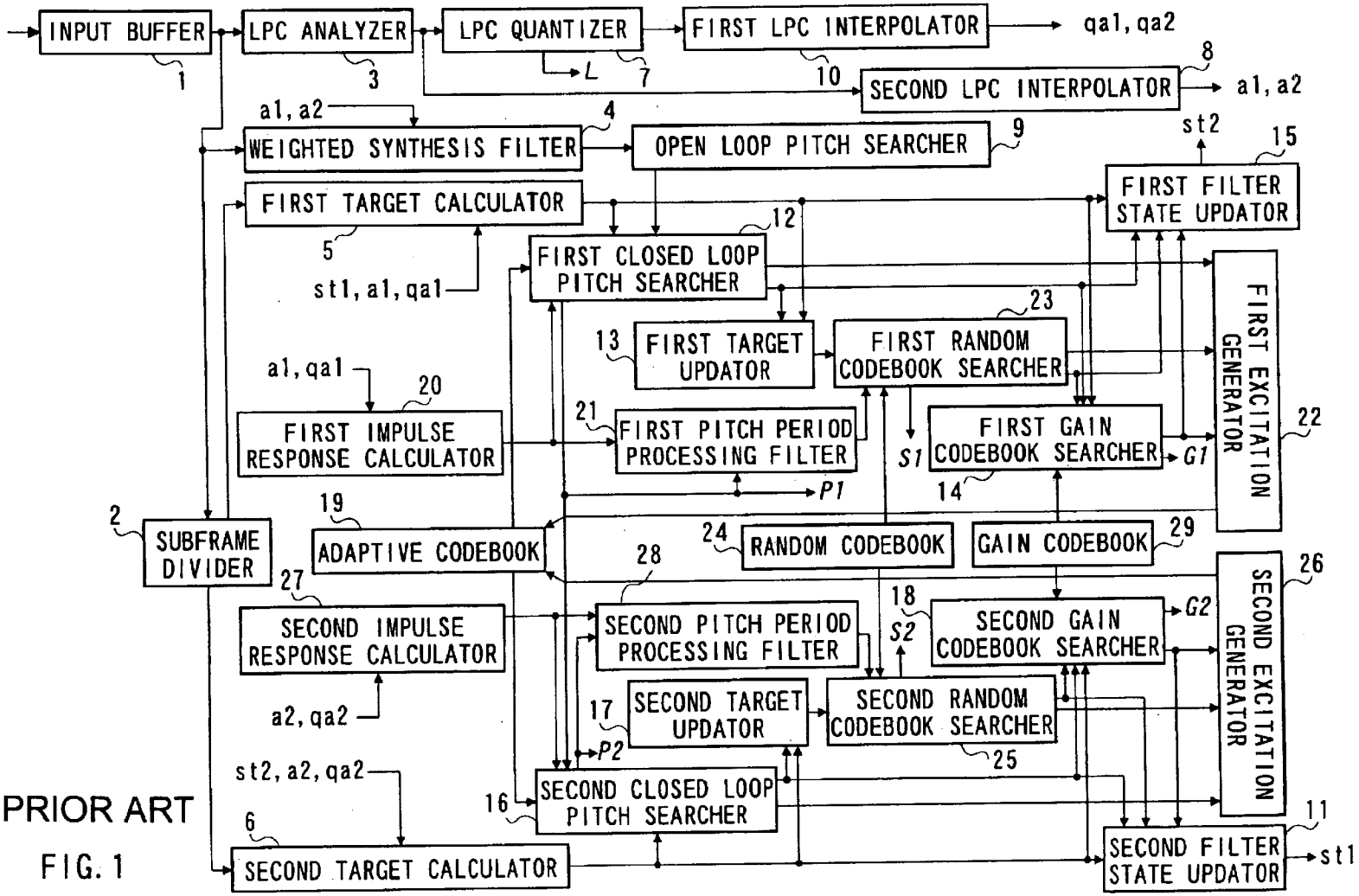
PRIOR ART FIG. 1
FIG. 1 is a block diagram illustrating a configuration of a conventional speech coding apparatus.
Figure 2:
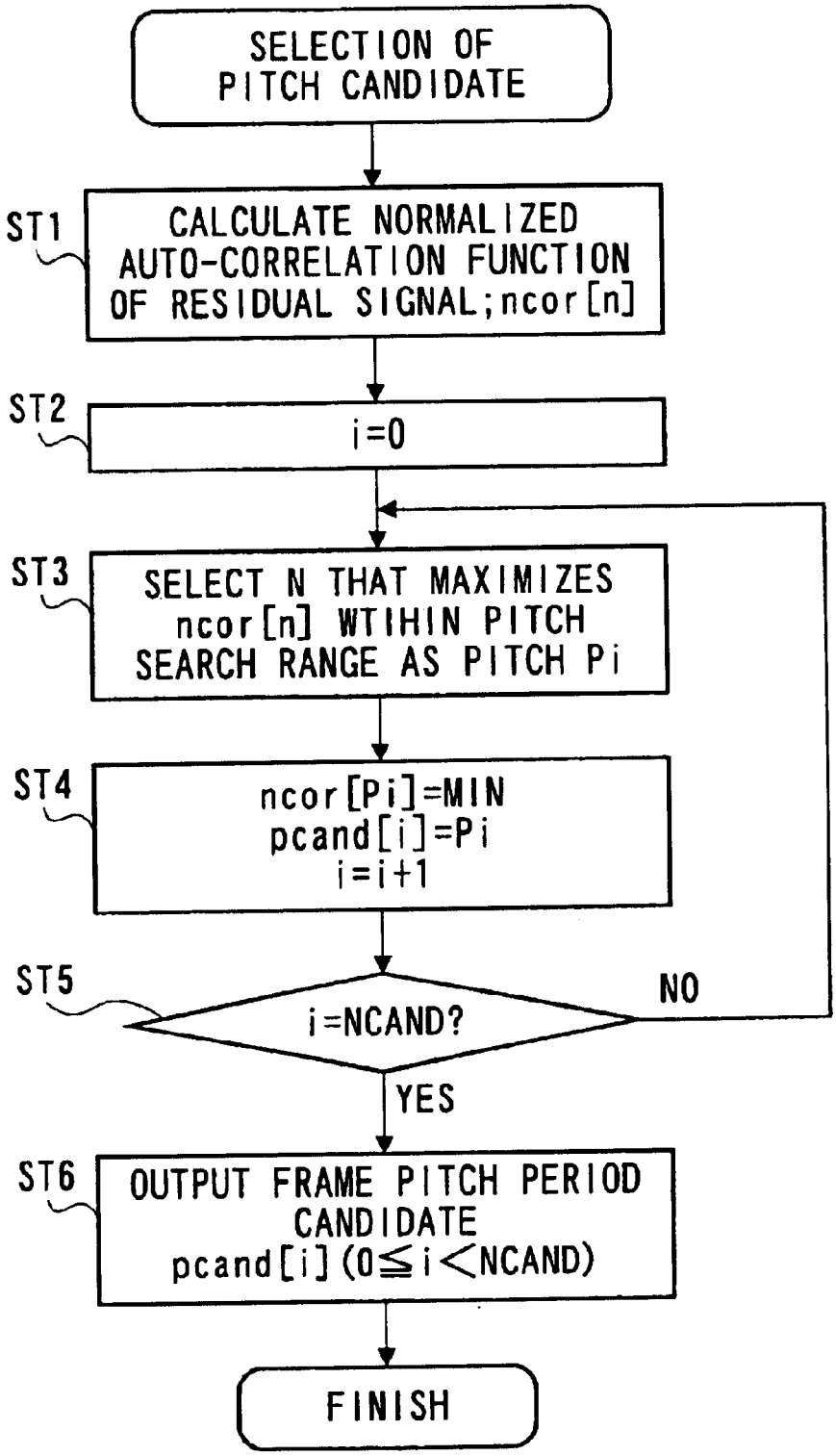
FIG. 2 is a flowchart illustrating processing in a conventional pitch candidate selector.

In a conventional pitch candidate selector corresponding to such a selector in this embodiment of the present invention, it is general to output pitch candidates itself output from first candidate selector 602 (to the closed loop pitch searcher). FIG. 2 illustrates a flowchart of such processing. In FIG. 2, first at ST1, the normalized auto-correlation function of the residual signal; ncor[n] (Pmin≦n≦Pmax, Pmin is a lower limit of the pitch search range, and Pmax is an upper limit of the pitch search range) is obtained. Next at ST2, pitch candidate number counter (loop counter) i is cleared to be 0. Next at ST3, n that maximizes ncor[n] (Pmin≦n≦Pmax) is selected as pitch candidate Pi. Next at ST4, ncor[Pi] is cleared by minimum value MIN, Pi is stored for pcand[i] as (i+1)thpitch candidate, and pitch candidate number counter (loop counter) i is incremented. Next at ST5, it is determined whether pitch candidate number counter (loop counter) i goes up to the predetermined candidate number; NCAND, and when i does not go up to NCAND, the loop processing of ST3 to ST5 is repeated, while the loop processing is finished to shift to processing of ST6, and NCAND pitch candidates are output when i goes up to NCAND.

However in such a method that simply selects the NCAND pitch candidates in descending order of the normalized auto-correlation function, there may be a case that a pitch candidate such that the normalized auto-correlation function is not sufficiently high is left as a candidate in lower order. Further there may be another case that such a candidate has high correlation with a first subframe, but has low correlation with a second subframe. In this case, when the closed loop pitch search is performed on the first subframe, candidate selector 602 may select such a candidate as a final pitch in the closed loop search on the first subframe even if the order of such a pitch is low (among the pitch candidates selected in FIG. 2). Since such a pitch is specialized for the first subframe, the coded speech quality deteriorates largely when the quantization of pitch differential value is performed on a pitch of the second subframe.

To solve the above problem, the present invention provides the coding apparatus with second candidate selector 605 not to output a candidate with insufficiently high correlation in the case where the auto-correlation is calculated over the entire frame, while outputting a plurality of pitch candidates, whereby it is intended to prevent a pitch specialized for the first subframe from being selected in the closed loop pitch search on the first subframe.

FIG. 9 is a flowchart illustrating processing contents in pitch candidate selector 509 illustrated in FIG. 8. In FIG. 9, first at ST201, the normalized auto-correlation function of the residual signal; ncor[n],Pmin≦n≦Pmax (Pmin is the lower limit of the pitch search range, and Pmax is the upper limit of the pitch search range) is obtained. Next at ST202, pitch candidate number counter i is cleared to be 0. Next at ST203, n (Pmin≦n≦Pmax) that maximizes ncor[n] is selected as P0. Next at ST204, a value of ncor[P0] is substituted for ncor_max, ncor[P0] is cleared by MIN (minimum value), P0 is stored for pcand[0] as the first pitch candidate, and pitch candidate number counter i is incremented.

Next at ST205, the same processing as performed at ST203 is performed, and n (Pmin≦n≦Pmax) that maximizes ncor[n] is selected as Pi. Next at ST206, it is determined whether ncor[Pi] is equal to or more than thresholdTh×ncor_max. Herein Th is a constant to set a threshold. When it is determined that ncor[Pi] is equal to or more than the threshold at ST206, the processing of ST207 is performed, ncor[Pi] is cleared by MIN, Pi is stored for pcand[i] as (i+1)th candidate, and candidate number counter i is incremented. After ST207, at ST208, it is determined whether candidate number counter i goes up to the predetermined number; NCAND, and when i does not go up to NCAND, the processing flow is returned to ST205, and the loop processing of ST205 to ST207 is repeated.

When loop counter i goes up to NCAND at ST208, the loop processing of candidate selection is finished, and the processing flow shifts to processing of ST209. Further also the processing flow shifts to ST209 when ncor[Pi] is less than the threshold to shift to the processing for finishing the candidate selection. At ST209, the value of candidate number counter i is stored for the number of candidates; ncan. Finally pitch candidate pcand[n] (0≦n<ncand) and the number of pitch candidates; ncan are output.

Figure 10:
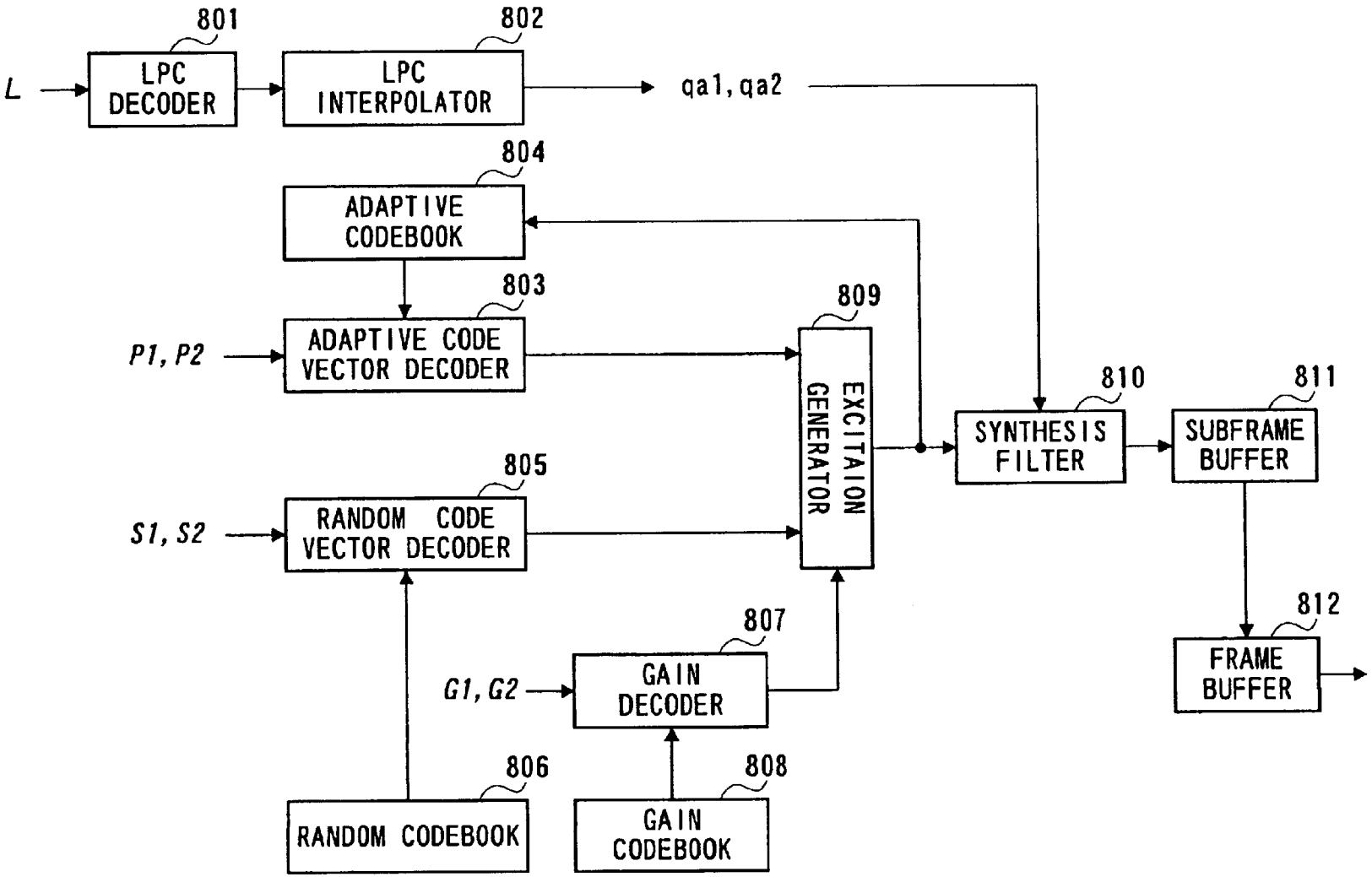
FIG. 10 is a block diagram illustrating a configuration of a speech decoding apparatus in the above embodiment.

FIG. 10 is a block diagram illustrating a decoding apparatus according in the second embodiment of the present invention. The following explains the configuration and operation of the apparatus with reference to FIG. 10. In FIG. 10, LPC decoder 801 decodes LPC from information L of LPC transmitted from a coder side to output to LPC interpolator 802. LPC interpolator 802 receives the LPC output from LPC decoder 801, and outputs qa1 and qa2 that are respectively quantized (decoded) LPC of the first and second subframes to synthesis filter 810.

Adaptive code vector decoder 803 receives pitch information P1 and P2 respectively of the first subframe and second subframe transmitted from the coder side, and based on pitch P1 and P2, retrieves adaptive code vectors from adaptive codebook 804 to output to excitation generator 809.

Adaptive codebook 804 buffers the excitation vector output from excitation generator 809 while updating for each subframe, to output to adaptive code vector decoder 803. Random code vector decoder 805 receives random codebook information S1 and S2 respectively of the first subframe and subframes transmitted from the coder side, and retrieves random code vectors respectively corresponding to S1 and S2 from the random codebook to output to excitation generator 809. Random codebook 806 stores the same contents as the codebook in the coder side, and outputs the random code vector to random code vector decoder 805.

Gain decoder 807 receives gain information G1 and G2 respectively of the first and second subframes transmitted from the coder side, retrieves gains respectively corresponding to G1 and G2 from gain codebook 808, and decodes the quantized gains to output to excitation generator 809. Gain codebook 808 stores the same contents as that in the coder side, and outputs the quantized gain to gain decoder 807. Excitation generator 809 receives the adaptive code vector, random code vector and decoded gain respectively from adaptive code vector decoder 803, random code vector decoder 805 and gain decoder 807, and outputs a generated excitation vector to synthesis filter 810 and adaptive codebook 804.

Synthesis filter 810 is constructed with qa1 and qa2 output from LPC interpolator 802, and receives as a filter input the excitation vector output from excitation generator 809 to perform the filtering, and outputs a decoded speech signal to subframe buffer 811. Subframe buffer 811 stores the decoded speech signal corresponding to a single subframe output from synthesis filter 810 to output to frame buffer 812. Frame buffer 812 receives as an input the decoded speech signal corresponding to the single subframe output from subframe buffer 811, and stores the decoded signal corresponding to a single frame (two subframes) to output.

The following explains about the operation of the decoding apparatus with the above-mentioned configuration with reference to FIG. 10. LPC information L transmitted from the coder side is decoded in LPC decoder 801. Interpolator 802 performs the same interpolation processing as in the coder side on decoded LPC, and obtains ga1 that is the quantized LPC of the first subframe and qa2 that is the quantized LPC of the second subframe. The interpolation processing is to obtain qa1 by the linear interpolation on qa1 decoded on a last frame and qa2 decoded on a current frame in LSP area. In addition, the LPC decoded from the transmitted LPC information L is used as qa2. qa1 is used to construct the synthesis filter for the first subframe, and qa2 is used to construct the synthesis filter for the second subframe.

Pitch information P1 and P2 respectively of the first and second subframes transmitted from the coder side is input to adaptive code vector decoder 803. Since P2 is subjected to the quantization of pitch differential value using P1, a pitch that is actually used on the second subframe is obtained "P1+P2".

First using P1, the adaptive code vector of the first subframe is retrieved from adaptive codebook 804, and output to excitation generator 809 as a decoded adaptive code vector. Random code information S1 and S2 respectively of the first and second subframes transmitted from the coder side is input to the random code vector decoder, and first using S1, the random code vector of the first subframe is retrieved from random codebook 806, and output to excitation generator 809.

Gain information G1 and G2 transmitted from the coder side is input to gain decoder 807, and first using G1, the gain of the first subframe is retrieved from gain codebook 808, and output to excitation generator 809. Excitation generator 809 adds a vector obtained by multiplying the adaptive code vector output from adaptive code vector decoder 803 by the adaptive code gain output from gain decoder 807, and another vector obtained by multiplying the random code vector output from random code vector decoder 805 by the random code gain output from gain decoder 807, to output to the synthesis filter.

The decoded excitation vector output to the synthesis filter is concurrently output to adaptive codebook 404 also, and contained in the adaptive codebook used for a next subframe. Synthesis filter 811, constructed with qa1, receives as an input the decoded excitation vector output from excitation generator 809, and synthesizes a decoded speech for the first subframe to output to subframe buffer 811. The contents of subframe buffer 811 is copied at a first half of frame buffer 812. Next the same speech decoding processing is performed using pitch information P2 (and P1), random code information S2, gain information G2, and qa2 that are decoded LPC, each of the second subframe, and a decoded speech signal for the second subframe is output to subframe buffer 811, and copied at a latter half of frame buffer 812. Finally the decoded speech signals corresponding to two subframes (one frame) buffered in frame buffer 813 are output from the decoder, and thereby the decoding processing is finished on the one frame of the speech signal.

In addition, while this embodiment adopts the residual signal as an input signal in pitch candidate selector 509 in performing the pitch candidate selection, it may be possible to perform with the weighted input speech signal as illustrated in pitch candidate selector 109 in the first embodiment.

According to the embodiment as described above, it is possible to achieve the speech coding apparatus and speech coding/decoding apparatus that retain one or more candidates in obtaining pitch candidates using input data including subframes on which the quantization of pitch differential value is performed, thereby achieves the pitch search with improved accuracy, and is capable of avoiding the risk, which is caused by retaining too more candidates, of selecting a pitch specialized for a subframe on which the quantization of pitch differential value is performed.

Third Embodiment

Figure 11:
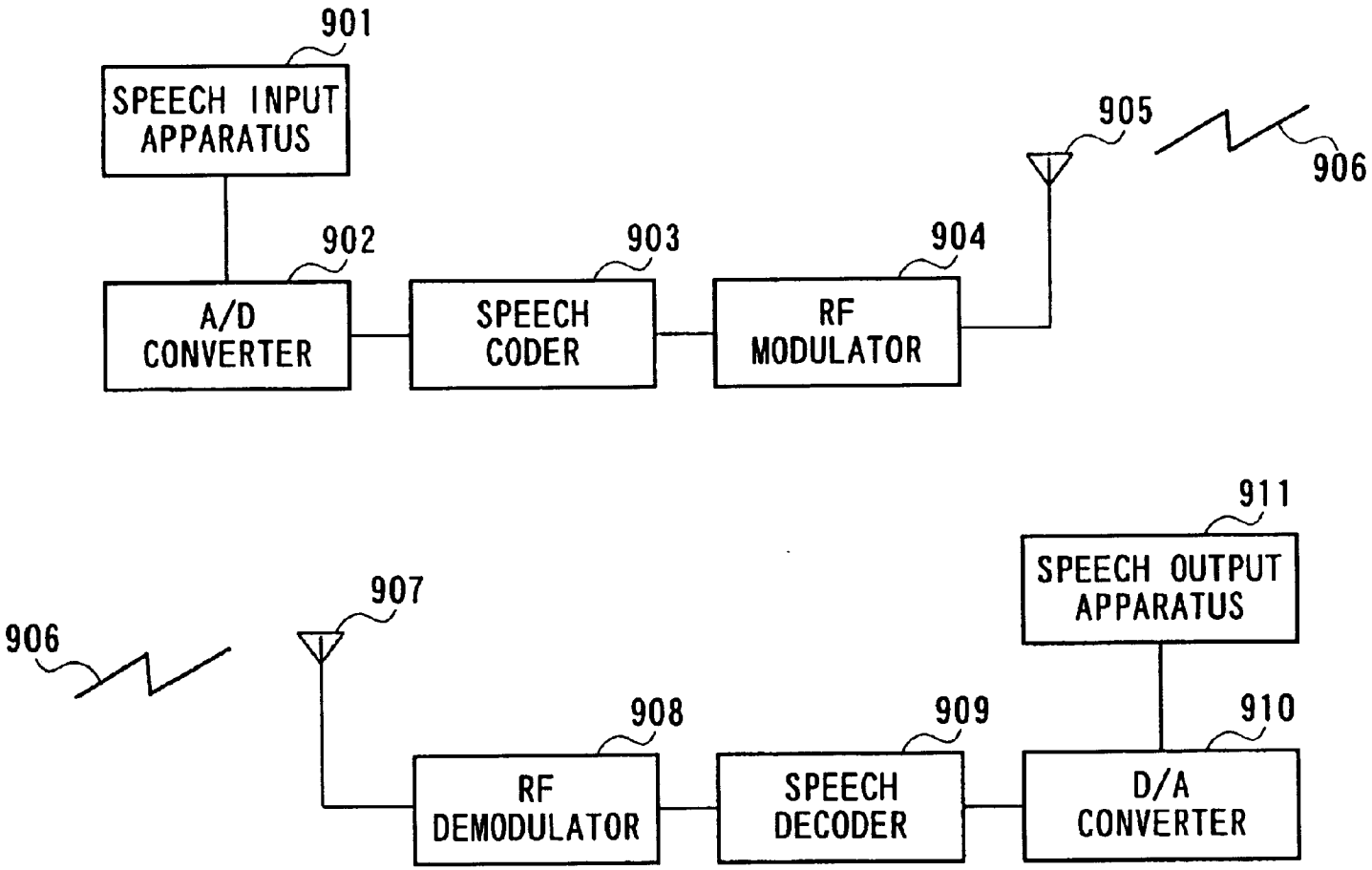
FIG. 11 is a block diagram illustrating configurations of a transmission apparatus provided with the speech coding apparatus of the present invention and a reception apparatus.

FIG. 11 is a block diagram illustrating a speech signal transmitter and receiver respectively provided with the speech coding apparatus and speech decoding apparatus according to either of the first or second embodiment of the present invention. In FIG. 11, speech input apparatus 901 such as a microphone converts a speech signal into an electric signal to output to A/D converter 902. A/C converter 902 converts an analog speech signal output form the speech input apparatus into a digital signal to output to speech coder 903.

Speech coder 903 performs speech coding with the speech coding apparatus according to the first or second embodiment of the present invention to output to RF modulator 904. RF modulator 904 converts speech information coded with speech coder 903 into a signal to be transmitted over transmission medium such as a radio wave to output to transmission antenna 905. Transmission antenna 905 transmits a transmission signal output from RF modulator 905 as the radio wave (RF signal) In addition "906" in FIG. 11 denotes the radio wave (RF signal) transmitted from transmission antenna 905.

Further reception antenna 907 receives radio wave (RF signal) 906 output to RF demodulator 908. RF demodulator 908 converts a received signal input from reception antenna 907 into a coded speech signal to output to speech decoder 909. Speech decoder 909 receives as an input the coded speech signal output from the RF modulator, performs decoding processing with the speech decoding apparatus as described in the first or second embodiment of the present invention, and outputs a decoded speech signal to D/A converter 910. D/A converter 910 converts the decoded speech input from speech decoder 909 into an analog speech signal to output to speech output apparatus 911. Speech output apparatus 911 such as a speaker receives the analog speech signal input from the D/A converter, and outputs a speech.

The speech signal transmitter and receiver with the above-mentioned configuration are explained with reference to FIG. 11. First a speech.is converted into an electric analog signal by speech input apparatus 901, and output to A/D converter 902. Then the analog speech signal is converted into a digital speech signal by A/D converter 902, and output to speech coder 903. Then speech coder 903 performs speech coding processing, and outputs coded information to RF modulator 904. Then the RF modulator performs processing such as modulation, amplification, and code spreading to transmit the coded information of the speech signal as a radio signal, to output to transmission antenna 905. Finally radio wave (RF signal) 906 is transmitted from transmission antenna 905.

Meanwhile in the receiver, radio wave (RF signal) 906 is received with reception antenna 907, and the received signal is provided to RF demodulator 908. RF demodulator performs processing such as code despreading and demodulation to convert the radio signal into coded information, and outputs the coded information to speech decoder 909. Speech decoder 909 performs decoding processing on the coded information, and outputs a digital decoded speech signal to D/A converter 910. D/A converter 910 converts the digital decoded speech signal output from speech decoder 909 into an analog decoded speech signal to output to speech output apparatus 911. Finally speech output apparatus 911 converts an electric analog decoded speech signal into a decoded speech to output.

The above-mentioned transmitter and receiver can be applied to a mobile station or base station apparatus in mobile communication apparatuses such as portable phones. In addition, the medium for use in transmitting information is not limited to the radio wave as described in this embodiment, and it may be possible to use an optosignal, and further possible to use a cable transmission path.

In addition, it may be possible to achieve the operations of the speech coding apparatuses and speech decoding apparatuses as described in the first and second embodiments, and the transmission apparatus and reception apparatus as described in the third embodiment, as software recorded on a recording medium such as a magnetic disc, optomagnetic disc, and ROM cartridge. By the use of such a recording medium with, for example, a personal computer using the recording medium, it is possible to achieve the speech coding apparatus/decoding apparatus and transmission apparatus/reception apparatus.

The speech coding apparatus and speech decoding apparatus of the present invention are applicable to a transmission apparatus and reception apparatus in a base station apparatus and communication terminal apparatus in a digital radio communication system.

As described above, the speech coding apparatus of the present invention is capable of representing pitches of a plurality of subframes on which the quantization is performed on the pitch differential value using a periodicity of an input signal and pitch information, and of extracting an appropriate pitch as a pitch lag in an adaptive codebook. In the present invention, in the constitution where a plurality of pitch candidates are preliminarily selected, and then a pitch is selected for each subframe, the number of preliminarily selected candidates is limited by the threshold processing in preliminarily selecting a plurality of pitch candidates, whereby it is possible to suppress the deterioration of the speech quality in the case where the pitch period is subjected to the quantization of pitch differential value between subframes.

Further according to the present invention, it is possible to achieve a transmission apparatus or reception apparatus capable of providing improved high speech qualities by providing the above-mentioned speech coding apparatus or speech decoding apparatus as a speech coder or speech decoder in the transmission apparatus or reception apparatus.

This application is based on the Japanese Patent Application No. HEI10-305740 filed on Oct. 27, 1998, entire content of which is expressly incorporated by reference herein.

Industrial Applicability

The CELP type speech coding apparatus of the present invention is applicable to a communication terminal apparatus such as a mobile station and base station apparatus in a digital radio communication system.

What is claimed is:

1. A CELP type speech coding apparatus comprising:

parameter coding means for coding a parameter representative of a spectral characteristic of a speech;

periodicity coding means for coding a periodicity of an excitation vector using an adaptive codebook storing previously generated excitation vectors; and excitation component coding means for coding an excitation vector component that cannot be represented with the adaptive codebook, using a random codebook storing predetermined excitation vectors, wherein said periodicity coding means having:

pitch candidate selecting means for performing preliminary selection of a pitch for the adaptive codebook on a subframe on which the pitch for the adaptive codebook is not subjected to quantization of pitch differential value, among subframes obtained by dividing unit frame, and selecting at least one pitch candidate adaptively.

2. The CELP type speech coding apparatus according to claim 1, wherein said pitch candidate selecting means comprising:

auto-correlation function calculation means for obtaining a normalized auto-correlation function using a previous weighted input speech signal and a new weighted input speech signal;

sorting means for sorting auto-correlation functions into a plurality of ranges corresponding to the pitch in the adaptive codebook;

a plurality of search means for searching a maximum value of an auto-correlation function in a respective range, and a pitch corresponding to the auto-correlation function;

threshold calculating means for obtaining a predetermined threshold using the auto-correlation functions searched in the plurality of search means; and selecting means for selecting a pitch corresponding to the auto-correlation function exceeding the threshold among the auto-correlation functions searched in the plurality of search means.

3. A speech signal transmission apparatus having a speech input apparatus that converts a speech signal into an electric signal, a CELP type speech coding apparatus that performs coding processing on a signal output from the speech input apparatus, and a transmission apparatus that transmits a coded signal output from the CELP type speech coding apparatus, said CELP type speech coding apparatus comprising:

parameter coding means for coding a parameter representative of a spectral characteristic of a speech;

periodicity coding means for coding a periodicity of an excitation vector using an adaptive codebook storing previously generated excitation vectors; and excitation component coding means for coding an excitation vector component that cannot be represented with the adaptive codebook, using a random codebook storing predetermined excitation vectors, wherein said periodicity coding means having:

pitch candidate selecting means for performing preliminary selection of a pitch for the adaptive codebook on a subframe on which the pitch for the adaptive codebook is not subjected to quantization of pitch differential value, among subframes obtained by dividing unit frame, and selecting at least one pitch candidate adaptively.

4. A speech coding/decoding apparatus comprising:

a CELP type speech decoding apparatus having means for decoding coded information of a parameter representative of a spectral characteristic of a speech;

means for decoding an adaptive code vector using an adaptive codebook storing previously generated excitation vectors;

means for decoding a random code vector using a random codebook storing predetermined excitation vectors; and means for decoding respective amplitudes of an adaptive codebook component and random codebook component; and a CELP type coding apparatus having:

parameter coding means for coding the parameter representative of the spectral characteristic of the speech;

periodicity coding means for coding a periodicity of the excitation vector using the adaptive codebook storing previously generated excitation vectors; and excitation component coding means for coding an excitation vector component that cannot be represented with the adaptive codebook, using the random codebook storing predetermined excitation vectors, wherein said periodicity coding means including:

pitch candidate selecting means for performing preliminary selection of a pitch for the adaptive codebook on a subframe on which the pitch for the adaptive codebook is not subjected to quantization of pitch differential value, among subframes obtained by dividing unit frame, and selecting at least one pitch candidate adaptively.

5. A speech signal transmission/reception apparatus having a speech coding/decoding apparatus, a speech input apparatus that converts a speech signal into an electric signal, a transmission apparatus that transmits a coded signal output from a CELP type coding apparatus, and a speech output apparatus that converts a decoded signal into the speech signal, said speech coding/decoding apparatus comprising:

a CELP type speech decoding apparatus having:

means for decoding coded information of a parameter representative of a spectral characteristic of a speech;

means for decoding an adaptive code vector using an adaptive codebook storing previously generated excitation vectors;

means for decoding a random code vector using a random codebook storing predetermined excitation vectors; and means for decoding respective amplitudes of an adaptive codebook component and random codebook component; and a CELP type coding apparatus having:

parameter coding means for coding the parameter representative of the spectral characteristic of the speech;

periodicity coding means for coding the periodicity of the excitation using the adaptive codebook storing previously generated excitation vectors; and excitation component coding means for coding an excitation vector component that cannot be represented with the adaptive codebook, using the random codebook storing predetermined excitation vectors, wherein said periodicity coding means including:

pitch candidate selecting means for performing preliminary selection of a pitch for the adaptive codebook on a subframe on which the pitch for the adaptive codebook is not subjected to quantization of pitch differential value, among subframes obtained by dividing unit frame, and selecting at least one pitch candidate adaptively.

6. A base station apparatus provided with a speech signal transmission/reception apparatus, said speech signal transmission/reception apparatus having a speech coding/decoding apparatus, a speech input apparatus that converts a speech signal into an electric signal, a transmission apparatus that transmits a coded signal output from a CELP type coding apparatus, and a speech output apparatus that converts a decoded signal into the speech signal, said speech coding/decoding apparatus comprising:

a CELP type speech decoding apparatus having means for decoding coded information of a parameter representative of a spectral characteristic of a speech;

means for decoding an adaptive code vector using an adaptive codebook storing previously generated excitation vectors;

means for decoding a random code vector using a random codebook storing predetermined excitation vectors; and means for decoding respective amplitudes of an adaptive codebook component and random codebook component; and a CELP type coding apparatus having:

parameter coding means for coding the parameter representative of the spectral characteristic of the speech;

periodicity coding means for coding a periodicity of an excitation vector using the adaptive codebook storing previously generated excitation vectors; and excitation component coding means for coding an excitation vector component that cannot be represented with the adaptive codebook, using the random codebook storing predetermined excitation vectors, wherein said periodicity coding means including:

pitch candidate selecting means for performing preliminary selection of a pitch for the adaptive codebook on a subframe on which the pitch for the adaptive codebook is not subjected to quantization of pitch differential value, among subframes obtained by dividing unit frame, and selecting at least one pitch candidate adaptively.

7. A communication terminal apparatus provided with a speech signal transmission/reception apparatus, said speech signal transmission/reception apparatus having a speech coding/decoding apparatus, a speech input apparatus that converts a speech signal into an electric signal, a transmission apparatus that transmits a coded signal output from a CELP type coding apparatus, and a speech output apparatus that converts a decoded signal into the speech signal, said speech coding/decoding apparatus comprising:

a CELP type speech decoding apparatus having means for decoding coded information of a parameter representative of a spectral characteristic of a speech;

means for decoding an adaptive code vector using an adaptive codebook storing previously generated excitation vectors;

means for decoding a random code vector using a random codebook storing predetermined excitation vectors; and means for decoding respective amplitudes of an adaptive codebook component and random codebook component; and a CELP type coding apparatus having:

parameter coding means for coding the parameter representative of the spectral characteristic of the speech;

periodicity coding means for coding a periodicity of an excitation vector using the adaptive codebook storing previously generated excitation vectors; and excitation component coding means for coding an excitation vector component that cannot be represented with the adaptive codebook, using the random codebook storing predetermined excitation vectors, wherein said periodicity coding means including:

pitch candidate selecting means for performing preliminary selection of a pitch for the adaptive codebook on a subframe on which the pitch for the adaptive codebook is not subjected to quantization of pitch differential value, among subframes obtained by dividing unit frame, and selecting at least one pitch candidate adaptively.

8. A CELP type speech coding method comprising:

the parameter coding step of coding a parameter representative of a spectral characteristic of a speech;

the periodicity coding step of coding a periodicity of an excitation vector using an adaptive codebook storing previously generated excitation vectors; and the excitation component coding step of coding an excitation vector component that cannot be represented with the adaptive codebook, using a random codebook storing predetermined excitation vectors, wherein said periodicity coding step having:

the pitch candidate selecting step of performing preliminary selection of a pitch for the adaptive codebook on a subframe on which the pitch for the adaptive codebook is not subjected to quantization of pitch differential value, among subframes obtained by dividing unit frame, and selecting at least one pitch candidate adaptively.

9. The CELP type speech coding method according to claim 8, wherein said pitch candidate selecting step having the steps of:

obtaining a normalized auto-correlation function using a previous weighted input speech signal and a new weighted input speech signal;

sorting auto-correlation functions into a plurality of ranges corresponding to the pitch in the adaptive codebook;

searching a maximum value of an auto-correlation function in a respective range and a pitch corresponding to the auto-correlation function;

obtaining a predetermined threshold using searched auto-correlation functions; and selecting a pitch corresponding to the auto-correlation function exceeding the threshold among the searched auto-correlation functions.

10. A recording medium, readable by a computer, having a program recorded therein executable by the computer, said program comprising the procedures of:

obtaining a normalized auto-correlation function using a previous weighted input speech signal and a new weighted input speech signal;

sorting auto-correlation functions into a plurality of ranges corresponding to the pitch in the adaptive codebook;

searching a maximum value of an auto-correlation function in a respective range and a pitch corresponding to the auto-correlation function, obtaining a predetermined threshold using searched auto-correlation functions; and selecting a pitch corresponding to the auto-correlation function exceeding the threshold among the searched auto-correlation functions.

11. A CELP type speech coding apparatus comprising:

an analyzer that divides a speech signal into frames of predetermined length and performs linear prediction analysis on a per frame basis;

a linear prediction parameter coder that encodes a linear prediction parameter obtained in said analyzer;

a periodicity coder that operates on a per subframe basis, where a frame is divided into a plurality of subframes, to encode a periodicity of excitation using an adaptive codebook that stores a previously generated excitation vector; and an excitation component coder that encodes an excitation component that cannot be represented by means of the adaptive codebook, using a random codebook storing a predetermined excitation vector, wherein said periodicity coder, when performing differential coding such that pitch periods are encoded differentially between the subframes and the pitch period in at least one of said subframes is represented by its differential relative to the pitch period encoded in an earlier subframe, (i) selects a plurality of pitch period candidates in a subframe where the pitch period is not encoded differentially, based on a scale of an autocorrelation function of an input speech signal or an excitation signal, (ii) calculates a threshold from a maximum value of autocorrelation functions of the selected pitch period candidates, and (iii) preliminarily selects, from the selected pitch period candidates, at least one pitch period with the autocorrelation function above the threshold.

12. The CELP type speech coding apparatus according to claim 11, further comprising:

an autocorrelation function calculator that obtains a normalized autocorrelation function from a previous weighted input speech signal and a new weighted input speech signal;

a sorter that sorts autocorrelation functions into a plurality of ranges according to a pitch in the adaptive codebook;

a plurality of search devices that, for each range, search for a maximum value of the autocorrelation function and the pitch corresponding to said autocorrelation function;

a threshold calculator that calculates a predetermined threshold from the maximum value of the autocorrelation function; and a selector that, from the pitches searched by the plurality of search devices, selects the pitch corresponding to the autocorrelation function that exceeds said threshold.

13. A speech signal transmitting apparatus comprising:

a speech input apparatus that converts a speech signal to an electric signal;

a CELP type speech coder that encodes the electric signal output from said speech input apparatus; and a transmitting apparatus that transmits the coded signal output from said CELP type speech coding apparatus, wherein said CELP type speech signal coder comprises:

an analyzer that divides the speech signal into frames of a predetermined length and performs linear prediction analysis on a per frame basis;

a linear prediction parameter coder that encodes a linear prediction parameter obtained in said analyzer;

a periodicity coder that operates on a per subframe basis, where a frame is divided into a plurality of subframes, to encode a periodicity of excitation using an adaptive codebook that stores a previously generated excitation vector; and an excitation component coder that encodes an excitation component that cannot be represented by means of the adaptive codebook, using a random codebook storing a predetermined excitation vector, and wherein said periodicity coder, when performing differential encoding such that pitch periods are encoded differentially between the subframes and the pitch period in at least one of said subframes is represented by its differential relative to the pitch period encoded in an earlier subframe, (i) selects a plurality of pitch period candidates in a subframe where the pitch period is not encoded differentially, based on a scale of an autocorrelation function of an input speech signal or an excitation signal, (ii) calculates a threshold from a maximum value of the autocorrelation functions of the selected pitch period candidates, and (iii) preliminarily selects, from the selected pitch period candidates, at least one pitch period with the autocorrelation function above the threshold.

14. A speech coding/decoding apparatus comprising:

a CELP type speech coder comprising an analyzer that divides a speech signal into frames of a predetermined length and performs linear prediction analysis on a per frame basis;

a linear prediction parameter coder that encodes a linear prediction parameter obtained in said analyzer;

a periodicity coder that operates on a per subframe basis, where a frame is divided into a plurality of subframes, to encode a periodicity of excitation using an adaptive codebook that stores a previously generated excitation vector; and an excitation component coder that encodes an excitation component that cannot be represented by means of the adaptive codebook, using a random codebook storing a predetermined excitation vector, and a CELP type speech decoder that decodes coded information of a parameter representing a spectral characteristic of speech, decodes an adaptive code vector using an adaptive codebook that stores a previously generated excitation vector, decodes a random code vector using a random codebook that stores a predetermined excitation vector, and decodes an amplitude of an adaptive codebook component and a random codebook component, wherein the periodicity coder in said CELP type speech coder, when performing differential encoding such that pitch periods are encoded differentially between the subframes and the pitch period in at least one of said subframes is represented by its differential relative to the pitch period encoded in an earlier subframe, (i) selects a plurality of pitch period candidates in a subframe where the pitch period is not encoded differentially, based on a scale of an autocorrelation function of an input speech signal or an excitation signal, (ii) calculates a threshold from a maximum value of the autocorrelation functions of the selected pitch period candidates, and (iii) preliminarily selects, from the selected pitch period candidates, at least one pitch period with the autocorrelation function above the threshold.

15. A speech signal transmitting/receiving apparatus comprising:

a speech input apparatus that converts a speech signal to an electric signal;

a CELP type speech coder that encodes the signal output from said speech input apparatus;

a transmitting apparatus that transmits the coded signal output from said CELP type speech coder to a communication partner; a receiving apparatus that receives a signal transmitted from the communication partner;

a CELP type speech decoder that decodes the received signal output from the receiving apparatus; and a speech output apparatus that converts the decoded signal output from said CELP type speech decoder to a speech signal and outputs said speech signal, wherein said CELP type speech coder comprises:

an analyzer that divides the speech signal into frames of a predetermined length and performs linear prediction analysis on a per frame basis;

a linear prediction parameter coder that encodes a linear prediction parameter obtained in said analyzer;

a periodicity coder that operates on a per subframe basis, where a frame is divided into a plurality of subframes, to encode a periodicity of excitation vector using an adaptive codebook that stores a previously generated excitation vector; and an excitation component coder that encodes an excitation component that cannot be represented by means of the adaptive codebook, using a random codebook storing a predetermined excitation vector, and wherein said periodicity coder, when performing differential encoding such that pitch periods are encoded differentially between the subframes and the pitch period in at least one of said subframes is represented by its differential relative to the pitch period encoded in an earlier subframe, (i) selects a plurality of pitch period candidates in a subframe where the pitch period is not encoded differentially, based on a scale of an autocorrelation function of an input speech signal or an excitation signal, (ii) calculates a threshold from a maximum value of the autocorrelation functions of the selected pitch period candidates, and (iii) preliminarily selects, from the selected pitch period candidates, at least one pitch period with the autocorrelation function above the threshold.

16. A base station apparatus comprising:

a CELP type speech coder that encodes an electric signal to which a speech signal has been converted;

a transmitting apparatus that transmits the coded signal output from said CELP type speech coder to a communication partner;

a receiving apparatus that resolves a signal transmitted from the communication partner; and a CELP type speech decoder that decodes the received signal output from said receiving apparatus, wherein said CELP type speech coder comprises:

an analyzer that divides a speech signal into frames of a predetermined length and performs linear prediction analysis on a per frame basis;

a linear prediction parameter coder that encodes a linear prediction parameter obtained in said analyzer;

a periodicity coder that operates on a per subframe basis, where a frame is divided into a plurality of subframes, to encode a periodicity of excitation using an adaptive codebook that stores a previously generated excitation vector; and an excitation component coder that encodes an excitation component that cannot be represented by means of the adaptive codebook, using a random codebook storing a predetermined excitation vector, wherein said periodicity coder, when performing differential encoding such that pitch periods are encoded differentially between the subframes and the pitch period in at least one of said subframes is represented by its differential relative to the pitch period encoded in an earlier subframe, (i) selects a plurality of pitch period candidates in a subframe where the pitch period is not encoded differentially, based on a scale of an autocorrelation function of an input speech signal or an excitation signal, (ii) calculates a threshold from a maximum value of the autocorrelation functions of the selected pitch period candidates, and (iii) preliminarily selects, from the selected pitch period candidates, at least one pitch period with the autocorrelation function above the threshold.

17. A communication terminal apparatus comprising:

a speech input apparatus that converts a speech signal to an electric signal;

a CELP type speech coder that encodes the electric signal output from said speech input apparatus;

a transmitting apparatus that transmits the coded signal output from said CELP type speech coder to a communication partner; a receiving apparatus that receives a signal transmitted from the communication partner;

a CELP type speech decoder that decodes the received signal output from the receiving apparatus; and a speech output apparatus that converts the decoded signal output from said CELP type speech decoder to a speech signal and outputs said speech signal, wherein said CELP type speech coder comprises:

an analyzer that divides the speech signal into frames of a predetermined length and performs linear prediction analysis on a per frame basis;

a linear prediction parameter coder that encodes a linear prediction parameter obtained in said analyzer;

a periodicity coder that operates on a per subframe basis, where a frame is divided into at plurality of subframes, to encode a periodicity of excitation using an adaptive codebook that stores a previously generated excitation vector; and an excitation component coder that encodes an excitation component that cannot be represented by means of the adaptive codebook, using a random codebook storing a predetermined excitation vector, and wherein said periodicity coder, when performing differential encoding such that pitch periods are encoded differentially between the subframes and the pitch period in at least one of said subframes is represented by its differential relative to the pitch period encoded in an earlier subframe, (i) selects a plurality of pitch period candidates in a subframe where the pitch period is not encoded differentially, based on a scale of an autocorrelation function of an input speech signal or an excitation signal, (ii) calculates a threshold from a maximum value of the autocorrelation functions of the selected pitch period candidates, and (iii) preliminarily selects, from the selected pitch period candidates, at least one pitch period with the autocorrelation function above the threshold.

18. A CELP type speech coding method comprising the steps of:

dividing a speech signal into frames of a predetermined length and performing linear prediction analysis on a per frame basis;

encoding a linear prediction parameter obtained in the linear prediction analysis;

encoding a periodicity of excitation using an adaptive codebook that stores a previously generated excitation vector on a per sub frame basis, where a frame is divided into a plurality of sub frames; and encoding an excitation component that cannot be represented by means of the adaptive codebook, using a random codebook storing a predetermined excitation vector, wherein the periodicity encoding step, when differential coding is performed such that pitch periods are encoded differentially between the subframes and the pitch period in at least one of said subframes is represented by its differential relative to the pitch period encoded in an earlier subframe, further comprises the steps of: (i) selecting a plurality of pitch period candidates in a subframe where the pitch period is not encoded differentially, based on a scale of an autocorrelation function of an input speech signal or an excitation signal, (ii) calculating a threshold from a maximum value of the autocorrelation function of the selected pitch period candidates, and (iii) preliminarily selecting, from the selected pitch period candidates, at least one pitch period with the autocorrelation function above the threshold.

19. The CELP type speech coding method according to claim 18, further comprising the steps of:

obtaining a normalized autocorrelation function using a previous weighted input speech signal and a new weighted input speech signal;

sorting auto correlation functions into a plurality of ranges according to a pitch in the adaptive codebook;

searching, for each range, a maximum value of the autocorrelation function and the pitch corresponding to said autocorrelation function;

calculating a predetermined threshold from the maximum value of the autocorrelation function; and selecting, from the pitches searched in the searching step, the pitch corresponding to the autocorrelation function that exceeds said threshold.

* * * * *